US012297614B2

(12) United States Patent
Hagos

(10) Patent No.: US 12,297,614 B2
(45) Date of Patent: May 13, 2025

(54) PET WASTE SCOOPING DEVICE AND PET WASTE BAGS

(71) Applicant: Petros Fessahaye Hagos, La Mesa, CA (US)

(72) Inventor: Petros Fessahaye Hagos, La Mesa, CA (US)

( * ) Notice: Subject to any disclaimer, the term of this patent is extended or adjusted under 35 U.S.C. 154(b) by 910 days.

(21) Appl. No.: 17/390,347

(22) Filed: Jul. 30, 2021

(65) Prior Publication Data

US 2022/0034054 A1 Feb. 3, 2022

Related U.S. Application Data

(60) Provisional application No. 63/059,841, filed on Jul. 31, 2020.

(51) Int. Cl.
*E01H 1/12* (2006.01)

(52) U.S. Cl.
CPC ..... *E01H 1/1206* (2013.01); *E01H 2001/126* (2013.01); *E01H 2001/1266* (2013.01); *E01H 2001/128* (2013.01)

(58) Field of Classification Search
CPC ..... E01H 1/1206; E01H 2001/126; E01H 2001/1266; E01H 2001/128
See application file for complete search history.

(56) References Cited

U.S. PATENT DOCUMENTS

| | | | | |
|---|---|---|---|---|
| 3,733,098 | A | 5/1973 | Tobias | |
| 3,738,697 | A | 6/1973 | Kahan | |
| 3,841,686 | A | 10/1974 | Gallo et al. | |
| 4,014,584 | A | 3/1977 | Bau | |
| 4,042,269 | A | 8/1977 | Skermetta | |
| 4,179,145 | A | 12/1979 | Shinsako | |
| 4,194,777 | A | 3/1980 | Carns | |
| 4,225,174 | A | 9/1980 | Hennessy et al. | |
| 4,248,468 | A | 2/1981 | Hastings | |
| 4,316,627 | A | 2/1982 | Solypa | |
| 4,641,873 | A | 2/1987 | Nurnberger | |
| 5,380,054 | A | 1/1995 | Galvis | |
| 5,570,919 | A * | 11/1996 | Eusebe | B25J 1/04 294/111 |
| 6,196,601 | B1 | 3/2001 | Juntunen, Jr. | |
| 6,305,322 | B1 | 10/2001 | Patel | |
| 6,827,378 | B1 | 12/2004 | Wong | |
| 6,983,966 | B2 | 1/2006 | Azrikam | |
| 7,093,869 | B2 | 8/2006 | Jung | |
| 7,448,659 | B1 | 11/2008 | Auseklis | |
| 7,992,907 | B1 | 8/2011 | Dejesus | |
| 8,066,310 | B2 | 11/2011 | Ohare et al. | |
| 9,091,031 | B2 | 7/2015 | Naseem | |

(Continued)

FOREIGN PATENT DOCUMENTS

| | | | |
|---|---|---|---|
| WO | 9306307 | A1 | 4/1993 |
| WO | 2004077939 | A1 | 9/2004 |

(Continued)

*Primary Examiner* — Stephen A Vu
(74) *Attorney, Agent, or Firm* — MORRISON & FOERSTER LLP

(57) ABSTRACT

Provided are pet waste scooping devices that are useful for scooping waste from a pet, such as a dog, and also pet waste bags that are useful for collecting and securing pet waste, as well as packages and kits of the same, and methods of manufacturing and using the same.

11 Claims, 6 Drawing Sheets

(56) References Cited

U.S. PATENT DOCUMENTS

| | | | | |
|---|---|---|---|---|
| 9,121,152 | B2 | 9/2015 | Pedraza et al. | |
| 9,139,970 | B1 | 9/2015 | Little | |
| 9,187,871 | B1 | 11/2015 | Contreras | |
| 9,217,231 | B2 | 12/2015 | Briski et al. | |
| 9,578,850 | B2 | 2/2017 | Taylor et al. | |
| 9,833,894 | B2 * | 12/2017 | Buxton | B25J 1/02 |
| 9,974,282 | B2 | 5/2018 | Castano | |
| 10,370,809 | B1 | 8/2019 | Samen | |
| 10,370,810 | B1 * | 8/2019 | Times | E01H 1/1206 |
| 10,655,289 | B1 * | 5/2020 | Kelly | E01H 1/1206 |
| 10,697,142 | B1 | 6/2020 | Jackson et al. | |
| 10,709,112 | B1 | 7/2020 | Times-dudley | |
| 10,772,300 | B1 | 9/2020 | Hicks et al. | |
| 2004/0123812 | A1 | 7/2004 | Condon | |
| 2004/0124646 | A1 | 7/2004 | Peko | |
| 2004/0135386 | A1 | 7/2004 | Pineda | |
| 2009/0261605 | A1 * | 10/2009 | Sumner | A01K 27/004 119/796 |
| 2010/0176611 | A1 | 7/2010 | Merino-garcia | |
| 2014/0152031 | A1 | 6/2014 | Ballacchino | |
| 2015/0021943 | A1 | 1/2015 | Montgomery | |
| 2015/0313188 | A1 * | 11/2015 | Seller | A01K 23/005 294/1.3 |
| 2017/0191235 | A1 | 7/2017 | Bean | |
| 2018/0347131 | A1 | 12/2018 | Tiger | |
| 2019/0320617 | A1 | 10/2019 | Weatherly | |
| 2019/0387713 | A1 | 12/2019 | Smith | |
| 2020/0157753 | A1 | 5/2020 | Patterson | |
| 2024/0245036 | A1 | 7/2024 | Hagos | |

FOREIGN PATENT DOCUMENTS

| | | | |
|---|---|---|---|
| WO | 2005100695 | A1 | 10/2005 |
| WO | 2008033166 | A1 | 3/2008 |
| WO | 2011049653 | A1 | 4/2011 |

* cited by examiner

PET WASTE SCOOPING DEVICE AND PET WASTE BAGS

CROSS-REFERENCE TO RELATED APPLICATIONS

This application claims priority from U.S. provisional application 63/059,841, filed Jul. 31, 2020, the content of which is incorporated by reference in its entirety.

FIELD

The present disclosure relates to pet waste scooping devices, pet waste bags, and a methods of manufacturing and using the same.

BACKGROUND

Pets frequently need to release waste—such as while being taken on a walk or while on the owner's own property. This typically requires the owner to pick up the waste, especially when the waste is left somewhere other than on the owner's property.

Some devices have been developed for removing a pet's waste, but are not ideal because (1) they require that the owner "catch" the waste as it is exiting the pet, which may not be easy and may require the owner to bend over in an uncomfortable position for an extended prior of time, and may also be bothersome to the pet, and/or (2) they are large, cumbersome, and/or heavy, which is not ideal if the owner would like to go on an extended walk or run with the pet, and/or (3) they scoop not only the waste but also things like rocks, sand, or dirt that is below or adjacent to the waste, and/or (4) the surrounding grass, rocks, sand, or dirt can interfere with the device's ability to scoop the entire waste, and/or (5) they require the user to bend over in order to scoop the waste.

Moreover, some waste bags used for collecting waste are not ideal because, for instance, (1) they require the user to identify which end includes the opening, (2) they require extra effort to peel open the bag due to a lack of friction between the user's hand and the smooth plastic waste bag, and (3) they require the user to excessively handle the bag containing the waste by tieing the waste bag closed, which could also result in the undesirable smelling of the waste.

For at least these reasons, there is a need among consumers for a product that does not require the user to "catch" the waste as it is exiting the pet, is small, compact, and lightweight, avoids scooping up things like rocks, sand, and dirt along with the waste, is able to scoop the waste without interference from surrounding grass, rocks, sand, or dirt, and reduces the need for the user to bend over when scooping the waste. Further, there is a need among consumers for a waste bag that allows for easily identifying the end that includes the opening, that is easy to peel open, and is easy to seal closed.

SUMMARY

Provided herein are pet waste scooping devices, pet waste bags, and methods of manufacturing and using the same.

Also provided herein is a pet waste scooping device, comprising: a pole connected to a grabber comprising at least three appendages; and a rope connected to a latch that is configured to cause the at least three appendages to reversibly expand outward to an open position when the rope is pulled.

Also provided herein is a pet waste scooping device, comprising: an external pole connected to a grabber comprising at least three appendages; and an internal pole connected to a latch that is configured to cause the at least three appendages to reversibly expand outward to an open position when the internal pole is pulled.

In some of any of such embodiments, the pole is a collapsible pole. In some of any of such embodiments, the at least three appendages are connected to a grabber spring. In some of any of such embodiments, the latch comprises an arm on a hinge, and a latch spring is connected to the arm. In some of any of such embodiments, when the rope is pulled, each of the three or more appendages is contacted by the arm. In some of any of such embodiments, when the internal pole is pulled, each of the three or more appendages is contacted by the arm.

In some of any of such embodiments, the grabber is extendable and/or enlargeable. In some of any of such embodiments, the pet waste scooping device further comprises a button configured to carry out the extending and/or enlarging of the grabber while in a closed position. In some of any of such embodiments, the button is a slide-button that is connected to the at least three appendages. In some of any of such embodiments, when the slide-button is slid away from the handle end of the pole or the external pole, the at least three appendages are extended.

In some of any of such embodiments, the pet waste scooping device further comprises a waste bag dispenser.

In some of any of such embodiments, the pet waste scooping device further comprises an illuminating element.

Also provided herein is a pet waste bag, comprising: a body portion comprising an open end and a closed end; and a peelable adhesive strip connected to the body portion by an anchor. In some of any of such embodiments, when the peelable adhesive strip is peeled, the peelable adhesive strip remains connected to the body portion by the anchor. In some of any of such embodiments, the pet waste bag further comprises a gripping texture. In some of any of such embodiments, the open end comprises a rim and the gripping texture is located on or adjacent to the rim. In some of any of such embodiments, when the peelable adhesive strip is peeled, the portion of the peelable adhesive strip that is peeled off of the body portion comprises adhesive.

Also provided herein is a package of pet waste bags, comprising two or more of any pet waste bag provided herein.

Also provided herein is a pet waste collection kit, comprising: any pet waste scooping device provided herein; and any pet waste bag provided herein.

Also provided herein is a pet waste collection kit, comprising: any pet waste scooping device provided herein; and a package of any pet waste bags provided herein.

Also provided herein is a method of scooping waste from a pet, comprising: obtaining a pet waste scooping device provided herein that includes a rope; extending the collapsible pole to a longer length; pulling the rope; situating the three or more appendages around waste; and releasing the rope.

Also provided herein is a method of scooping waste from a pet, comprising: obtaining a pet waste scooping device provided herein that includes an internal pole; extending the collapsible pole to a longer length; pulling the internal pole; situating the three or more appendages around waste; and releasing the internal pole and/or returning the internal pole to its location prior to the pulling of the internal pole.

Also provided herein is a method of scooping waste from a pet, comprising: obtaining a pet waste scooping device provided herein that includes a rope; extending the collapsible pole to a longer length; pulling the rope; obtaining a pet waste bag provided herein; placing the pet waste bag over the three or more appendages; situating the three or more appendages around waste; and releasing the rope.

Also provided herein is a method of scooping waste from a pet, comprising: obtaining a pet waste scooping device provided herein that includes an internal pole; extending the collapsible pole to a longer length; pulling the internal pole; obtaining a pet waste bag provided herein; placing the pet waste bag over the three or more appendages; situating the three or more appendages around waste; and releasing the internal pole and/or returning the internal pole to its location prior to the pulling of the internal pole.

Also provided herein is a pet waste scooping device, comprising: a pole connected to a grabber comprising at least three appendages; and a rope connected to a latch that is configured to cause the at least three appendages to reversibly expand outward to an open position when the rope is pulled. In some embodiments, the pet waste scooping device further comprises a stopper connected to the rope. In some embodiments, the pole has a handle end and a scooping end, and wherein the pet waste scooping device further comprises a stopper connected to the rope at the handle end of the pole. In some of any of such embodiments, the pet waste scooping device further comprises a wrist loop connected to the rope. In some of any of such embodiments, the pet waste scooping device further comprises a wrist loop connected to the stopper. In some of any of such embodiments, the rope passes through the interior of the pole. In some of any of such embodiments, the rope comprises an elastic rope. In some of any of such embodiments, the rope is a coiled cord. In some of any of such embodiments, the coiled coil comprises a rope covered in rubber.

Also provided herein is a pet waste scooping device, comprising: a pole connected to a grabber comprising at least three appendages; and an internal pole connected to a latch that is configured to cause the at least three appendages to reversibly expand outward to an open position when the internal pole is pulled. In some embodiments, the pet waste scooping device further comprises a stopper connected to the internal pole. In some of any of such embodiments, the pole has a handle end and a scooping end, and wherein the pet waste scooping device further comprises a stopper connected to the internal pole at the handle end of the pole. In some embodiments, the pet waste scooping device further comprises a wrist loop connected to the internal pole. In some embodiments, the pet waste scooping device further comprises a wrist loop connected to the stopper. In some of any of such embodiments, the internal pole is a collapsible pole. In some of any of such embodiments, the internal pole is a telescoping collapsible pole.

In some of any of such embodiments, the pole is a collapsible pole. In some of any of such embodiments, the pole is a telescoping collapsible pole.

In some of any of such embodiments, the at least three appendages are connected to a grabber spring. In some of any of such embodiments, the grabber spring is a compression spring. In some of any of such embodiments, the at least three appendages are curved. In some of any of such embodiments, the grabber comprises three, four, five, six, seven, or eight appendages. In some of any of such embodiments, the grabber comprises four appendages.

In some of any of such embodiments, the latch is connected to a latch spring. In some of any of such embodiments, the latch comprises an arm. In some of any of such embodiments, the latch comprises an arm, and a latch spring is connected to the arm. In some of any of such embodiments, the arm is one, two, three, four, five, six, seven, or eight arms. In some of any of such embodiments, the arm is on a hinge. In some of any of such embodiments, each of the three or more appendages is contacted by an arm. For instance, in some embodiments, the arm is one, two, three, four, five, six, seven, or eight arms, and each of the three or more appendages is contacted by at least one of these arms. In some embodiments, the contacting between the arm and the appendage is when the rope or the internal pole is pulled by the user. In some of any of such embodiments, the latch spring is a compression spring.

In some of any of such embodiments, the grabber is extendable and/or enlargeable. In some of any of such embodiments, the grabber is extendable and/or enlargeable while in a closed position. In some of any such embodiments, the pet waste scooping device further comprises a button configured to carry out the extending and/or enlarging of the grabber while in a closed position. In some of any of such embodiments, the button is a slide-button. In some of any of such embodiments, when extended and/or enlarged, the diameter of the grabber increases by at least 25%, at least 50%, at least 75%, at least 100%, at least 150%, at least 200%, at least 300%, at least 400% or at least 500%. In some of any such embodiments, the slide-button is connected to the grabber. In some of any such embodiments, the slide-button is connected to the at least three appendages. In some of any such embodiments, when the slide-button is slid away from the handle end of the external pole, the at least three appendages are extended.

In some of any such embodiments, the pet waste scooping device further comprises a waste bag dispenser. In some of any of such embodiments, the waste bag dispenser is attached to the pole. In some of any of such embodiments, the waste bag dispenser is configured to contain at least 1, at least 2, at least 3, at least 4, at least 5, at least 10, at least 15, at least 20, at least 25, or at least 30 waste bags. In some of any of such embodiments, the waste bag dispenser comprises a storage compartment. In some of any such embodiments, the pet waste scooping device further comprises a pet waste bag. In some embodiments, the pet waste scooping device further comprises a package of pet waste bags.

In some of any such embodiments, the pet waste scooping device further comprises an illuminating element. In some of any such embodiments, the illuminating element comprises a light emitting diode (LED). In some of any such embodiments, the illuminating element is connected to the pole. In some of any such embodiments, the illuminating element is connected to the grabber. In some of any such embodiments, the illuminating element is connected to the waste bag dispenser.

Also provided herein is a pet waste bag, comprising: a body portion comprising an open end and a closed end; and a peelable adhesive strip connected to the body portion by an anchor.

In some embodiments, the peelable adhesive strip is located on the open end of the body portion. In some of any such embodiments, the open end comprises a rim and the peelable adhesive strip is located on or adjacent to the rim. In some of any such embodiments, the open end comprises a rim and the peelable adhesive strip is located no more than 0.5 inch, 1 inch, 1.5 inch, 2 inches, 2.5 inches, or 3 inches from the rim.

In some of any such embodiments, the anchor is located on the open end of the body portion. In some of any such embodiments, the open end comprises a rim and the anchor is located on or adjacent to the rim. In some of any such embodiments, the open end comprises a rim and the anchor is located no more than 0.5 inch, 1 inch, 1.5 inch, 2 inches, 2.5 inches, or 3 inches from the rim.

In some of any such embodiments, when the peelable adhesive strip is peeled, the peelable adhesive strip remains connected to the body portion by the anchor. In some of any such embodiments, the peelable adhesive strip comprises an adhesive side and a non-adhesive side. In some of any such embodiments, when the peelable adhesive strip is peeled, the portion of the peelable adhesive strip that is peeled off of the body portion comprises adhesive. In some of any such embodiments, when the peelable adhesive strip is peeled, the portion of the peelable adhesive strip that is not peeled off of the body portion does not comprise adhesive.

In some of any such embodiments, the peelable adhesive strip is, is about, or is at least 0.5 inch, at least 0.75 inch, at least 1 inch, at least 1.5 inch, at least 2 inches, at least 2.5 inches, at least 3 inches, at least 3.5 inches, at least 4 inches, at least 4.5 inches, at least 5 inches, at least 5.5 inches, or at least 6 inches in length.

In some of any such embodiments, the pet waste bag further comprises a gripping texture. In some of any such embodiments, the gripping texture comprises a raised texture. In some of any such embodiments, the raised texture comprises one or more of raised dots, raised lines, ridges, raised shapes, or any combination thereof. In some of any such embodiments, the gripping texture is located on or adjacent to the open end. In some of any such embodiments, the open end comprises a rim and the gripping texture is located on or adjacent to the rim.

In some of any such embodiments, the gripping texture is located on about 1% to about 10%, about 1% to about 20%, about 5% to about 20%, about 5% to about 30%, about 5% to about 40%, about 5% to about 50%, about 10% to about 20%, about 10% to about 40%, about 10% to about 50%, about 10% to about 60%, about 20% to about 40%, about 20% to about 60%, about 20% to about 80%, about 40% to about 95%, about 40% to about 85%, about 40% to about 75%, about 25% to about 75%, about 30% to about 70%, about 35% to about 65%, about 40% to about 60%, or about 45% to about 55% of the perimeter of the rim. In some of any such embodiments, the gripping texture extends for up to about 0.5 inch, up to about 1 inch, up to about 2 inches, up to about 3 inches, up to about 4 inches, up to about 5 inches, or up to about 6 inches.

In some of any such embodiments, the body portion comprises plastic. In some of any such embodiments, the plastic is selected from the group consisting of high-density polyethylene (HDPE), low-density polyethylene (LDPE), and linear low-density polyethylene (LLDPE). In some embodiments, the body portion of the pet waste bag comprises HDPE.

In some of any such embodiments, the body portion comprises a biodegradable material. In some of any such embodiments, the biodegradable material is a biodegradable plastic material. In some of any such embodiments, the biodegradable material comprises a cellulose-based material.

In some of any such embodiments, the open end and/or the closed end further comprises a perforated edge.

Also provided herein is a package of pet waste bags, comprising two or more of any of the pet waste bag provided herein.

In some embodiments, the two or more of the pet waste bag is, is about, is at least, or is at least about 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 100, 125, 150, 175, 200, 225, or 250 of the pet waste bag of any one of embodiments provided herein.

In some of any such embodiments, the two or more pet waste bags are linked together. In some of any such embodiments, the two or more pet waste bags are linked together by a perforated edge. In some of any such embodiments, the two or more pet waste bags are linked together, and each of the two or more pet waste bags comprise a perforated edge on the open end and/or the closed end of the body portion.

Also provided herein is pet waste collection kit, comprising: any pet waste scooping device provided herein; and any pet waste bag provided herein. In some embodiments, the pet waste collection kit further comprises instructions for use.

Also provided herein is a pet waste collection kit, comprising: any pet waste scooping device provided herein; and any package of pet waste bags provided herein. In some embodiments, the pet waste collection kit further comprises instructions for use.

Also provided herein is a method of manufacturing a pet waste scooping device, comprising: obtaining a pole; connecting the pole to a grabber comprising at least three appendages; connecting a rope to a latch that is configured to cause the at least three appendages to reversible expand outward to an open position when the rope is pulled; and connecting a spring to the at least three appendages.

Also provided herein is a method of manufacturing a pet waste scooping device, comprising: obtaining a pole; connecting the pole to a grabber comprising at least three appendages; connecting an internal pole to a latch that is configured to cause the at least three appendages to reversible expand outward to an open position when the internal pole is pulled; and connecting a spring to the at least three appendages.

In some of any of such embodiments, the method further comprises connecting an illuminating element to the pole. In some of any of such embodiments, the method further comprises connecting a button to the pole for extending and/or enlarging the grabber while in a closed position. In some of any of such embodiments, the method further comprises connecting a waste bag dispenser to the pole. In some of any of such embodiments, the pole is a collapsible pole.

Also provided herein is a method of manufacturing a pet waste bag, comprising: obtaining a body portion comprising an open end and a closed end; connecting a peelable adhesive strip to the body portion; and applying a gripping texture to the body portion.

In some of any of such embodiments, the method further comprises connecting an anchor that connects the peelable adhesive strip to the body portion.

Also provided herein is a method of scooping waste from a pet, comprising: obtaining any pet waste scooping device provided herein that includes a rope and a collapsible pole; extending the collapsible pole to a longer length; pulling the rope; situating the three or more appendages around waste; and releasing the rope.

Also provided herein is a method of scooping waste from a pet, comprising: obtaining any pet waste scooping device provided herein that includes an internal pole and a collapsible pole; extending the collapsible pole to a longer length; pulling the internal pole; situating the three or more appendages around waste; and releasing the internal pole and/or returning the internal pole to its location prior to the pulling of the internal pole.

Also provided herein is a method of scooping waste from a pet, comprising: obtaining any pet waste scooping device provided herein that includes a rope and a collapsible pole; extending the collapsible pole to a longer length; pulling the rope; obtaining any pet waste bag provided herein; placing the pet waste bag over the three or more appendages; situating the three or more appendages around waste; and releasing the rope.

Also provided herein is a method of scooping waste from a pet, comprising: obtaining any pet waste scooping device provided herein that includes an internal pole and a collapsible pole; extending the collapsible pole to a longer length; pulling the internal pole; obtaining any pet waste bag provided herein; placing the pet waste bag over the three or more appendages; situating the three or more appendages around waste; and releasing the internal pole and/or returning the internal pole to its location prior to the pulling of the internal pole.

In some of any such embodiments, the method of scooping waste from a pet further comprises peeling the peelable adhesive strip, and wrapping the portion of the peelable adhesive strip that is peeled off of the body portion and comprises adhesive around the open end of the pet waste bag, thereby sealing the waste inside of the pet waste bag.

BRIEF DESCRIPTION OF THE DRAWINGS

FIG. 3 depicts the grabber in a closed position, such as when the rope is released or is otherwise not being pulled. In this closed position, the tension caused by the spring 105 keeps the grabber in a closed position. Although not depicted in this embodiment, a second spring 105 is connected to the latch 102 (also referred to as a latch spring) in some embodiments.

FIG. 5 depicts a portion of an exemplary embodiment of a pet waste scooping device that includes an internal pole 114, a similar embodiment is envisioned that replaces the internal pole with a rope 101, as described herein. Also, although not depicted in this embodiment, a second spring 105 is connected to the grabber 103 or the appendages 104 of the grabber (also referred to as a latch spring), in some embodiments.

Figure 6:
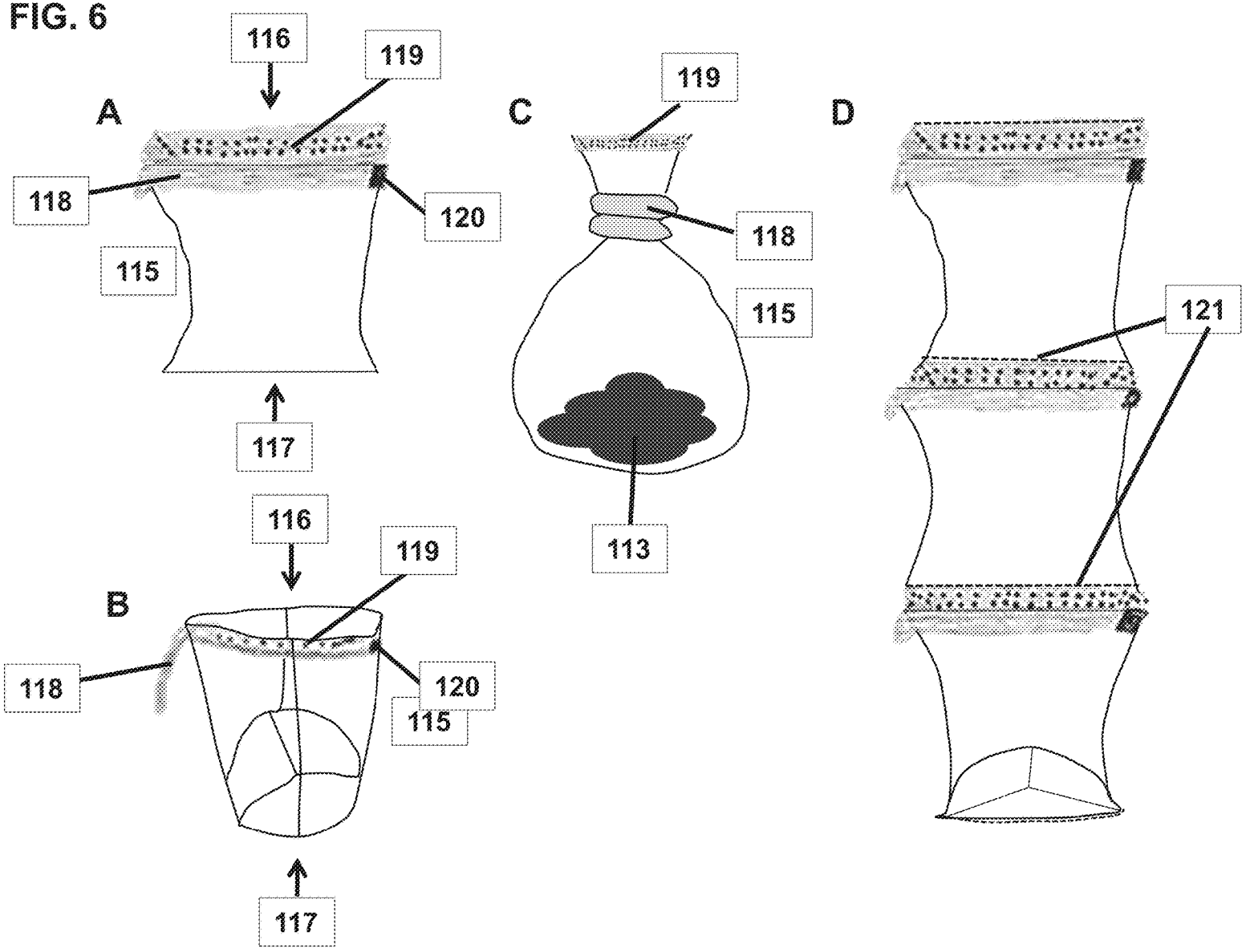

FIG. 6 depicts exemplary embodiments and configurations for a pet waste bag 115. FIG. 6A depicts an exemplary pet waste bag 115 comprising a body portion comprising an open end 116, a closed end 117, a peelable adhesive strip 118 situated along the open end, a gripping texture 119 situated along the open end, and an anchor 120 that connects the peelable adhesive strip 118 to the body portion such that the peelable adhesive strip remains attached to the body portion after being fully peeled. FIG. 6B depicts an exemplary pet waste bag 115 comprising a body portion comprising an open end 116, a closed end 117, a peelable adhesive strip 118 situated along the open end, a gripping texture 119 situated along the open end, and an anchor 120 that connects the peelable adhesive strip 118, which is depicted in an opened configuration that is ready to receive waste. The exemplary pet waste bag depicted in FIG. 6B comprises a round closed end. FIG. 6C depicts an exemplary pet waste bag 115 after the bag has collected the waste 113 and the peelable adhesive strip 118 has been used to seal closed the open end of the pet waste bag. In this embodiment depicted in FIG. 6C, the peelable adhesive strip, after being fully peeled, was wrapped around the closed end multiple times in order to seal the pet waste bag closed in an air-tight manner via the adhesive on the portion of the peelable adhesive strip that was peeled off the body portion, which allowed for the quick and easy sealing of the pet waste bag without the need for tieing the bag closed, which can involve a large amount of undesirable handling of the bag containing the smelly waste. FIG. 6D depicts an exemplary embodiment of three pet waste bags linked to one another in a sequence and separated by a perforated edge 121 on the open and closed end of each pet waste bag, which allows for easy separation of each individual bag for use.

DETAILED DESCRIPTION

The pet waste scooping devices and methods described herein advantageously provide for a small, light-weight, compact pet waste scooping device that is able to scoop the waste without interference from surrounding grass, rocks, sand, or dirt, while also reducing the need for the user to bend over when scooping the waste, illuminating the waste to be scooped along with the user's surroundings, and avoiding scooping up things like rocks, sand, and dirt along with the waste.

The pet waste bags and methods of use and production thereof described herein advantageously provide a pet waste bag where the end of the waste bag that includes the opening is easy to identify, where the pet waste bag is easy to peel open, and where the pet waste bag is easy and quick to seal closed.

All publications, including patent documents, scientific articles and databases, referred to in this application are incorporated by reference in their entirety for all purposes to the same extent as if each individual publication were individually incorporated by reference. If a definition set forth herein is contrary to or otherwise inconsistent with a definition set forth in the patents, applications, published applications and other publications that are herein incorporated by reference, the definition set forth herein prevails over the definition that is incorporated herein by reference.

The section headings used herein are for organizational purposes only and are not to be construed as limiting the subject matter described.

I. Pet Waste Scooping Device

The present disclosure provides pet waste scooping devices.

Specifically provided herein is a pet waste scooping device comprising a pole, a grabber, a rope, a latch, and a spring. In some embodiments, the pet waste scooping device further comprises a wrist loop and/or a stopper and/or an illuminating element and/or a waste bag dispenser. In some embodiments, the spring is a grabber spring and/or a latch spring.

Also provided herein is a pet waste scooping device comprising a pole, a grabber comprising at least three appendages, a button for reversibly expanding the appendages outward to an open position, a latch, and a spring. In some embodiments, the pet waste scooping device further comprises a wrist loop and/or a stopper and/or an illuminating element and/or a waste bag dispenser. In some embodiments, the pet waste scooping device further comprises a rope connected, directly or indirectly, to the button. In some embodiments, the spring is a grabber spring and/or a latch spring.

Also provided herein is a pet waste scooping device comprising a pole, a grabber comprising at least three appendages, an internal pole 114, a latch, and a spring. In some embodiments, the pet waste scooping device further comprises a wrist loop and/or a stopper and/or an illuminating element and/or a waste bag dispenser. In some embodiments, the spring is a grabber spring and/or a latch spring.

Figure 1:
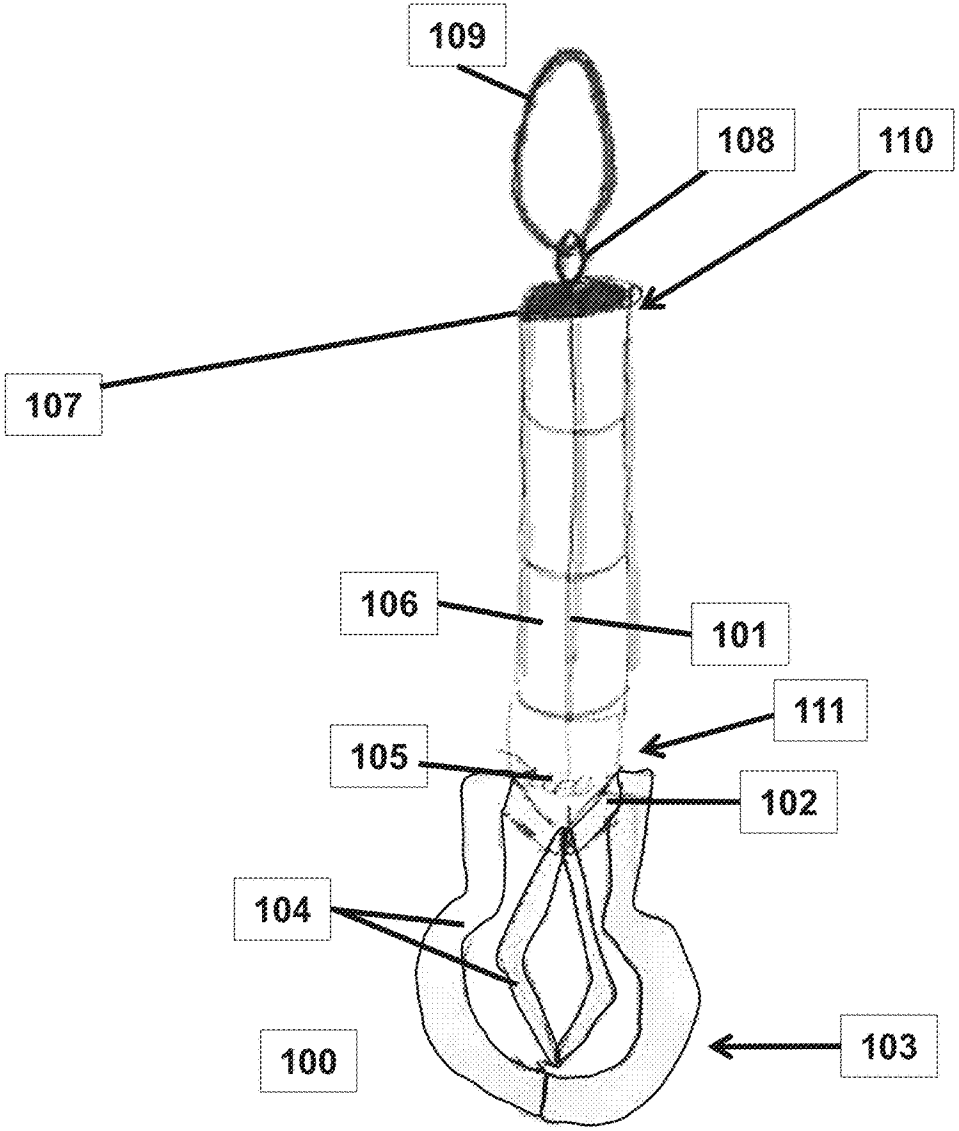
FIG. 1 depicts an exemplary embodiment of a pet waste scooping device 100 that includes a wrist loop 109, a stopper 108, a draw system that includes a rope 101 that is an elastic rope, a pole 106 that is a collapsible telescoping pole, a grabber 103 that includes four appendages 104, a spring 105 connected to the appendages 104 (also referred to as a grabber spring), a latch 102, and an illuminating element 107. The pole 106 includes a handle end 110 and a scooping end 111. The wrist loop is connected to the elastic rope, and the elastic rope is connected to the latch. The stopper is situated in between the rope and the wrist loop on the handle end 110 of the pole 106 and can act as a part that the user can grab for pulling the rope, and it can also function by limiting how far the rope can pass into the pole, such as when the rope is being pulled into the pole due to tension caused by the spring and/or the elastic rope. In this embodiment, the grabber opens up into an open position when the elastic rope is pulled by the user, and then the grabber closes around the waste into a closed position when the elastic rope is released by the user. In this embodiment, when the elastic rope is not being pulled, the resistance from the spring keeps the grabber in a closed position, and, when the elastic rope is pulled, the movement of the latch causes the appendages of the grabber to open up by expanding outward as the latch is being pulled. Although not depicted in this embodiment, a second spring 105 is connected to the latch 102 (also referred to as a latch spring) in some embodiments.

Turning now to the drawings, FIG. 1 depicts an embodiment of a pet waste scooping device 100 having a rope 101, a latch 102, a grabber 103, four appendages 104, a spring 105, a collapsible telescoping pole 106, an illuminating element 107, a stopper 108, and a wrist loop 109. The embodiment depicted in FIG. 1 includes a wrist loop 109 connected to the stopper 108, the stopper 108 is connected to the rope 101 that passes through the pole 106, the rope 101 is connected to the latch 102 that makes contact with the appendages 104 of the grabber 103, the spring 105 is connected to the appendages 104, and the illuminating device 107 is connected to the pole 106. In some embodiments, a spring 105 that is connected to the grabber, e.g., the at least three appendages of the grabber, is also referred to herein as a grabber spring.

Figure 5:
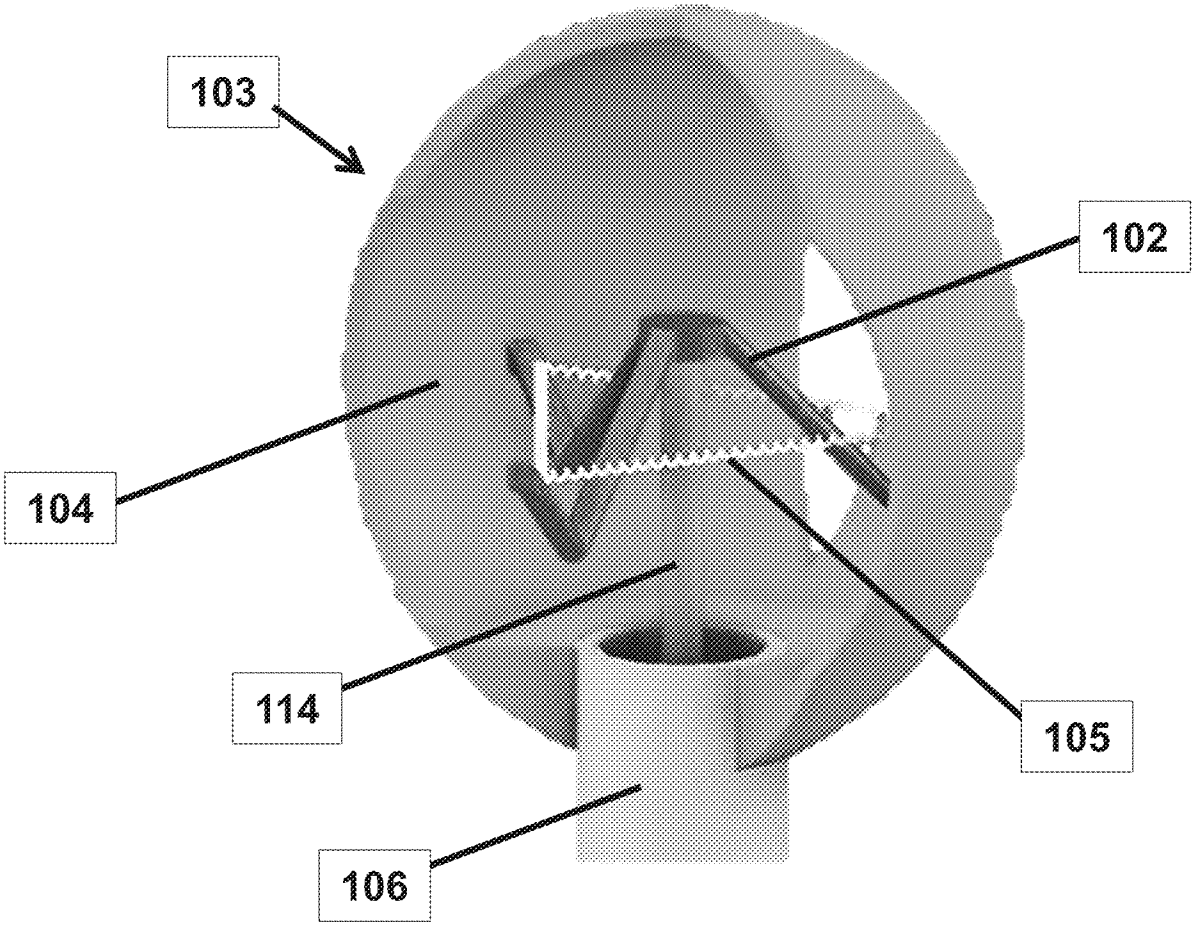
FIG. 5 depicts a portion of an exemplary embodiment of a pet waste scooping device that includes a grabber 103 that includes appendages 104, a spring 105 connected to the latch 102 (also referred to as a latch spring), an internal pole 114, and a pole 106 that is an external pole. The internal pole 114 is connected to the latch 102 and passes through the pole 106, and the pole 106 is connected to the appendages. In this embodiment, as the internal pole is pulled by the user, the latch, which includes arms that are held inward by the spring 105, is forced to open outward, which causes the appendages 104 to extend outward such that the grabber 103 is in an open position. In some embodiments, the latch 102 comprises an arm that is retracted inward due to tension caused by the spring, but, when the latch 102 is pulled toward the user by the rope or the internal pole, the arm of the latch is forced to expand outward against the tension caused by the spring, thereby pressing against the appendages of the grabber and causing the grapper to open up into an open position. In some embodiments, the arm is multiple arms, such as two, three, four, five, six, seven, or eight arms. A spring 105 that is connected to a latch 102 is also referred to herein as a latch spring. Although

In some embodiments, the rope 101 is replaced with an internal pole 114, such as depicted in FIG. 5, i.e., instead of comprising a rope 101 it comprises an internal pole 114. In some embodiments, the spring 105 is connected to the latch. Accordingly, in some embodiments, the wrist loop 109 is optionally connected to a stopper 108, and the wrist loop 109 is connected to the internal pole 114 or the rope 101 that passes through the pole 106, the internal pole 114 or the rope 101 is connected to the latch 102 that makes contact with the appendages 104 of the grabber 103, the spring 105 is connected to the appendages 104 and/or the latch 102, e.g., as separate springs (a first and a second spring) or the same spring, and the illuminating device 107, which is optional and present in some embodiments, is connected to the pole 106.

In some embodiments, the pole 106 is a collapsible pole. In some embodiments, the collapsible pole is a telescoping collapsible pole. In some embodiments, the pole is a telescoping collapsible pole, as depicted in FIG. 1. A collapsible pole, such as a telescoping collapsible pole, allows for the size, namely the length, of the pole to be greatly reduced when it is not being used for scooping pet waste, such as when the user is carrying it while walking a pet or jogging alongside the pet, and it is also advantageous by allowing for easier storage due to its compact size. In some embodiments, when the collapsible pole is fully extended, it is at least 18 inches, at least 2 feet, at least 2.5 feet, at least 3 feet, at least 3.5 feet, at least 4 feet, at least 4.5 feet, or at least 5 feet in length. In some embodiments, when the collapsible pole is fully retracted or collapsed, it is less than 4 inches, less than 6 inches, less than 8 inches, less than 10 inches, less than 12 inches, less than 14 inches, less than 16 inches, less than 18 inches, less than 20 inches, less than 22 inches, or less than 24 inches in length. In some embodiments, when the collapsible pole is fully extended, it is at least 1.5 times, 2 times, 2.5 times, 3 times, 3.5 times, or 4 or more times larger than when it is fully collapsed.

Figure 2:
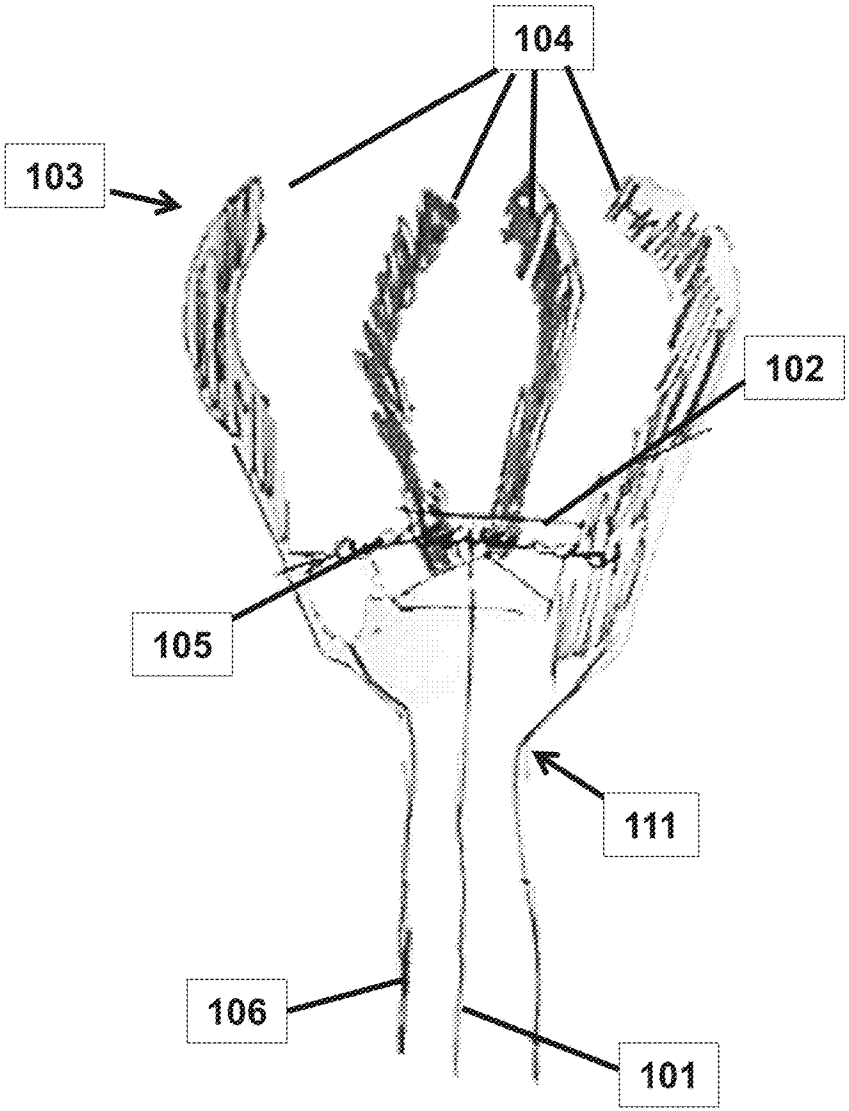
FIG. 2 depicts a portion of an exemplary embodiment of a pet waste scooping device that includes a grabber 103 that includes four appendages 104, a spring 105 connected to the appendages 104 (also referred to as a grabber spring), a latch 102, a pole 106 that is a collapsible telescoping pole, and a draw system includes a rope 101 that is an elastic rope. An illuminating element is not depicted in this drawing but is included in some embodiments and is connected to the collapsible telescoping pole. In this embodiment, the elastic rope is connected to the latch and passes through the collapsible telescoping pole, and the latch makes contact with the appendages, and the grabber is connected to the collapsible telescoping pole at the scooping end 111 of the pole 106. In this embodiment, the grabber opens up into an open position when the elastic rope is pulled by the user, and then the grabber closes around the waste into a closed position when the elastic rope is released by the user. In this embodiment, when the elastic rope is not being pulled, the resistance from the spring keeps the grabber in a closed position, and, when the elastic rope is pulled, the movement of the latch causes the appendages of the grabber to open up by expanding outward as the latch is being pulled. A spring 105 that is connected to the grabber, e.g., the at least three appendages of the grabber, is also referred to herein as a grabber spring. Although not depicted in this embodiment, a second spring 105 is connected to the latch 102 (also referred to as a latch spring) in some embodiments.

The pole includes a handle end 110 and a scooping end 111. The handle end is the end of the pole where the user typically holds the pet waste scooping device while using it to scoop or grab waste. As depicted in FIG. 2, the scooping end is on the opposite end from the handle end and is the end of the pole that is connected to the grabber, which is used for scooping or grabbing the waste. In some embodiments, the pole 106 is referred to as an external pole. For instance, in some embodiments comprising an internal pole 114, the pole 106 may be referred to as an external pole. As such, references to "an external pole" or "the external pole" is to be understood as referring to the pole 106, and references to "a pole" or "the pole" or "a pole 106" or "the pole 106" is to be understood as including, but not being limited to, reference to an external pole. In some embodiments, the pole 106 is an external pole. In some embodiments, the internal pole or the rope passes through the pole 106 (sometimes referred to as the external pole).

In some embodiments, the rope 101 passes through the interior of the pole from the handle end to the scooping end, as depicted in FIG. 1. In some embodiments, the rope 101 passes along the exterior of the pole from the handle end to the scooping end. In some embodiments, the rope comprises an elastomeric material. In some embodiments, the rope comprises an elastic rope. In some embodiments, the rope is an elastic rope. In some embodiments, a portion of the rope is elastic. In some embodiments, the rope includes a non-elastic portion and an elastic portion.

In some embodiments, the rope 101 is connected to a stopper 108, as depicted in FIG. 1. In some embodiments, the rope 101 passes through the stopper 108. In some embodiments, the stopper 108 is formed by tying a knot with the rope 101, such that the knot acts as the stopper 108. In some embodiments, the rope 101 passes through the stopper 108 and a knot is formed such that the knot catches on the stopper as the tension from the rope pulls inward in the direction of the grabber. In some embodiments, the stopper is connected to a wrist loop 109. The user can put his or her hand through the wrist loop to assist in carrying the pet waste scooping device. The wrist loop 109 can also be used for hanging the pet waste scooping device on a hook, on a bag, such as a backpack, on a stroller, or on endless other items. In some embodiments, the wrist loop 109 and/or the stopper 108, by virtue of their connection to the rope, can be used by the user to pull the rope by providing a safe and secure object for the user to hold on to.

In some embodiments, the rope 101 is coiled. In some embodiments, a portion of the rope 101 is coiled. In some embodiments, the rope 101 comprises a cord. In some embodiments, the cord is a coiled cord. In some embodiments, the coiled cord self-coils. The coiled cord can, in some embodiments, resemble a coiled telephone cord. A coiled cord allows a cord to be shorter in overall length (length from one end of the cord to the other) and more compact when in a resting state, and also provides for tension between the two ends, while allowing for the cord to stretch to a longer overall length (length from one end of the cord to the other) when the cord is pulled. An example of a coiled cord is a coiled telephone cord. In the context of the pet waste scooping device, the use of a coiled cord as the rope 101, or as a portion of the rope 101, would provide the rope 101 with a sufficient length regardless of whether the collapsible pole is fully collapsed, or is fully extended, or is only partially extended. The use of a coiled cord promotes tension between the two ends of the coiled cord regardless of whether the collapsible pole is fully collapsed, or is fully extended, or is only partially extended. This is beneficial because, for instance, when the collapsible pole is fully collapsed, the coiled coil would avoid the need for excess rope being stored outside of the pole, which could get tangled or could be dangerous by possibly causing the owner to trip and fall over the excess rope. Rather, the coiled coil, by virtue of self-coiling, becomes shorter in overall length (length from one end of the cord to the other) and more compact within the collapsible pole when the collapsible pole is fully collapsed.

The coiled cord can comprise any suitable material. In some embodiments, the coiled cord comprises an elastomeric material. In some embodiments, the coiled cord comprises rubber. In some embodiments, the coiled cord comprises a rope covered in rubber.

In some embodiments comprising a button for reversibly expanding the appendages outward to an open position, the button is connected to the latch. In some embodiments, the button is connected to the latch via a rope, such as any rope described herein. In some embodiments, the button is connected to the latch via an internal pole 114. In some embodiments, the internal pole 114 is a collapsible or telescoping pole. In some embodiments, the button is connected to the latch via an internal pulley.

In some embodiments, the pet waste scooping device 100 comprises a pole 106, an internal pole 114, a latch, a spring, and a grabber comprising at least three appendages, such as depicted in FIG. 5. In some embodiments, the internal pole 114 passes through the pole 106 (also referred to as the external pole) and is connected to the latch 102. In some embodiments, an arm of the latch is connected to the spring, and when the internal pole 114 is not being pulled, the resistance from the spring keeps the grabber in a closed position by keeping the arm of the latch retracted inward, and, when the internal pole 114 is pulled, the movement of the arm of the latch outward causes the appendages of the grabber to open up by expanding outward as the latch is being pulled. In some embodiments, the movement of the arm of the latch outward is caused by the latch making contact with the pole 106, or another object in connection with the pole 106, as the latch is being pulled due to its connectivity with the internal pole 114. In some embodiments, the internal pole 114 is a collapsible or telescoping pole. In some embodiments, the appendages of the grabber are on a hinge and/or are connected to a spring (also referred to as a grabber spring), which is different from the spring connected to the latch (also referred to as a latch spring). In some embodiments, the spring 105 is a latch spring. A latch spring is a spring 105 that is connected to the latch or the at least one arm of the latch.

In some embodiments, the pole 106 is connected to the grabber 103, such as depicted in FIG. 1, FIG. 2, and FIG. 5. In some embodiments, the grabber comprises at least three appendages 104. In some embodiments, the grabber comprises at least four appendages. In some embodiments, the grabber comprises four appendages, as depicted in FIG. 1 and FIG. 2, for instance. In some embodiments, the grabber comprises three, four, five, six, seven, or eight or more appendages. In some embodiments, the appendages function by grabbing or scooping the waste through tension caused by the spring, e.g., the grabber spring, that causes the appendages to retract inward toward a closed position when the rope is released or the internal pole is retracted, which helps secure the waste within the grabber. In particular, the at least three appendages surround the waste and then tension is applied to the waste as the appendages retract inward toward a closed position as a result of the tension caused by the spring connected to the appendages when the rope is released or the internal pole is retracted. The closed position, such as when the rope is released, is depicted in FIG. 1, whereas the open position caused by pulling the rope is depicted in FIG. 2. In some embodiments, the at least three appendages 104 are each on a hinge.

In some embodiments, the appendages are angled or curved, as depicted in FIG. 1, FIG. 2, FIG. 3, and FIG. 4. In some embodiments, the appendages are curved. In some embodiments, the appendages are angled. In some embodiments, the appendages angle or curve outward and then inward toward the center of the grabber. For instance, in some embodiments, the appendages extend outward from the center of the grabber beginning at the region where the grabber and the pole are connected, and then the appendages, after extending outward, curve or angle inward toward the center of the grabber as they extend further away from the region where the grabber and the pole are connected, which is nicely depicted, for instance, in FIG. 2 and FIG. 4. The angle or curve of the appendages allow for the grabber to more effectively scoop the waste and more securely contain it within the appendages after the rope is released and the appendages retract inward toward a closed position around the waste. The angle or curve is designed to wrap around the waste that is scooped up by the grabber in order to provide for a secure containment of the waste after it is scooped up. This allows for the waste to be securely moved from the ground to a waste bag or container, to a garbage container, or otherwise to the site intended for its disposition.

Figure 4:
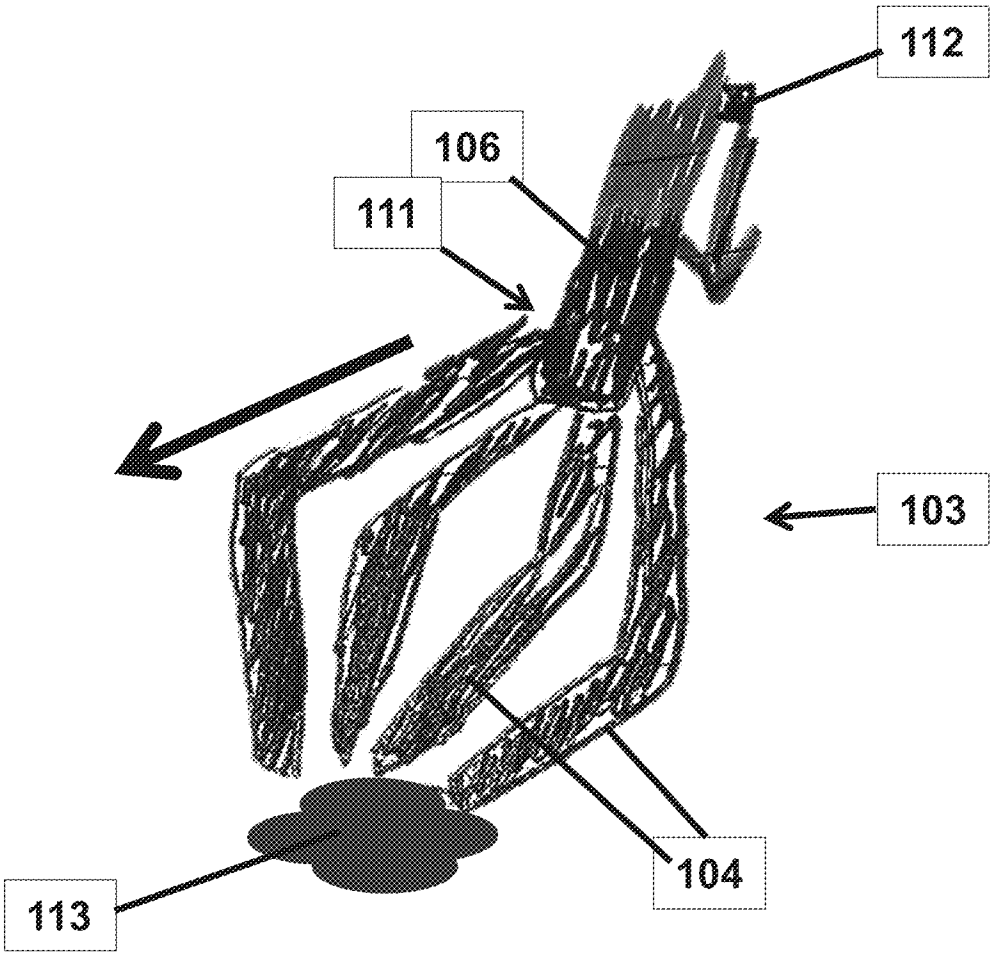
FIG. 4 depicts a portion of an exemplary embodiment of a pet waste scooping device that includes a grabber 103 that is extendable and/or enlargeable, and a button 112 that is a slide-button for extending and/or enlarging the grabber so that the grabber 102 is large enough to grab or scoop the waste 113. In this embodiment, as the slide-button is pressed down and is slid down the side of the pole 106 toward the scooping end 111 of the pole 106, the appendages extend so that the size of the grabber is extended and/or enlarged, which allows the longer appendages to surround larger waste for secure grabbing or scooping. Although not depicted in this embodiment, a second spring 105 is connected to the latch 102 (also referred to as a latch spring) in some embodiments.

In some embodiments, the grabber 103 is extendable and/or enlargeable, as depicted in FIG. 4. The ability to extend or enlarge the grabber allows for the size of the grabber, e.g., the diameter around the appendages and/or of the length of the appendages that protrude from the pole, to be adjustable based on the size of the waste, which can vary based on the breed and/or size of the pet. For instance, smaller breeds of dog, e.g., Chihuahuas, Yorkshire Terriers, Pomeranians, and Pugs, produce relatively small waste, while larger breeds of dog, e.g., Great Danes, Mastiffs, and Saint Bernards, produce much larger waste. Moreover, the size of waste that a pet, e.g., dog, produces will generally increase as the pet grows in size from birth until reaching its full adult size. For instance, a four week old Great Dane will generally produce much smaller waste than a fully grown four year old Great Dane. By having a grabber that is extendable and/or enlargeable, the same pet waste scooping device can be used to retrieve waste from multiple breeds of different sizes, such as if the user has multiple dogs of different breeds and/or sizes, and can also be used to retrieve waste from the same dog as it grows over time and gradually produces waste of increasing size. This is beneficial because, for instance, it saves the user the expense of purchasing multiple pet waste scooping devices suitable for retrieving waste of different size, and by the convenience of only having to carry one pet waste scooping device for multiple pets of different sizes, such as when walking multiple dogs.

Accordingly, in some embodiments, the grabber is extendable and/or enlargeable and the pet waste scooping device further comprises a button for extending and/or enlarging the grabber. In some embodiments, the button for extending and/or enlarging the grabber extends the length of the appendages. In some embodiments, the button for extending and/or enlarging the grabber extends the length of the appendages that protrude from the pole. In some embodiments, the button 112 for extending and/or enlarging the grabber comprises a button 112 that is a push-button or a slide-button that provides for extending the length of the appendages. The extension of the length of the appendages allows the grabber to securely grab a larger piece of waste than what could have been grabbed if the appendages were not extended. By including a grabber 103 that is extendable and/or enlargeable, the pet waste scooping device is able to be more compact by allowing the grabber to be reduced in size to the smallest possible size when the pet waste scooping device is not being used, such as during storage or when the owner is walking, jogging, or running with the pet. Since the smallest possible size for the grabber 103 may, for some users, be smaller than the size that would be used when a piece of waste is being grabbed, this provides the benefit of allowing the pet waste scooping device to have a smaller overall size than if the grabber 103 was non-extendable and/or non-enlargeable. In some embodiments, the button is a slide-button that is connected to the at least three appendages or to another part of the grabber. In some embodiments, when the slide-button is slid away from the handle end of the pole, e.g., the external pole, the at least three appendages are extended. For instance, in some embodiments, the slide-button is slid, pushed, or moved away from the handle end of the pole or the handle end of the external pole in the direction of the scooping end, i.e., the slide-button is slid, pushed, or moved in the direction of the waste, which causes the at least three appendages to extend in length and/or diameter. This can be due, for instance, to the slide-button being connected to the at least three appendages, thereby when the slide-button is slid, pushed, or moved outward in the direction of the scooping end and away from the handle end, a portion of the at least three appendages that was situated inside of the pole or the external pole extends outward outside of the pole, thereby leading to an extension and/or enlarging of the grabber.

In some embodiments, the grabber 103 is extendable and/or enlargeable such that, when fully extended or enlarged while in a closed position, the grabber has a diameter that is at least 25%, at least 50%, at least 75%, at least 100%, at least 125%, at least 150%, at least 175%, at least 200%, at least 225%, at least 250%, at least 275%, at least 300%, at least 325%, at least 350%, at least 375%, at least 400%, at least 425%, at least 450%, at least 475%, at least 500%, at least 600%, at least 700%, or at least 800% or more larger than the diameter of the grabber when fully condensed while in a closed position or if it were non-extendable and/or non-enlargeable. In some embodiments, the pet waste scooping device comprises a button configured to extend and/or enlarge the grabber while in a closed position. As used herein, the diameter of the grabber refers to the diameter across the three or more appendages. For instances, in an embodiment where the grabber comprises four appendages equally spaced apart, the diameter can be measured by measuring the distance between the opposite-facing appendages.

In some embodiments, the grabber 103 is extendable and/or enlargeable such that, when fully extended or enlarged while in a closed position, the length of the at least three appendages that increases by at least 25%, at least 50%, at least 75%, at least 100%, at least 125%, at least 150%, at least 175%, at least 200%, at least 225%, at least 250%, at least 275%, at least 300%, at least 325%, at least 350%, at least 375%, at least 400%, at least 425%, at least 450%, at least 475%, at least 500%, at least 600%, at least 700%, or at least 800% as compared to when the grabber 103 is full condensed while in a closed position or if it were non-extendable and/or non-enlargeable or before being extended and/or enlarged.

In some embodiments, the grabber 103 is connected to a spring 105, as depicted in FIG. and FIG. 2. In some embodiments, the at least three appendages 104 are connected to a spring 105. The connection between the at least three appendages and the spring causes the at least three appendages to reversibly retract inward toward a closed position due to tension caused by the spring. The spring 105 may include individual springs. In some embodiments, a single spring is connected to each of the at least three appendages. In some embodiments, more than one spring is used to connect to the at least three appendages. The spring 105 can be any spring that provides tension and is not limited. In some embodiments, the spring 105 is a compression spring. In some embodiments, the spring 105 is a grabber spring. A grabber spring is a spring 105 that is connected to the grabber or the at least three appendages of the grabber.

Figure 3:
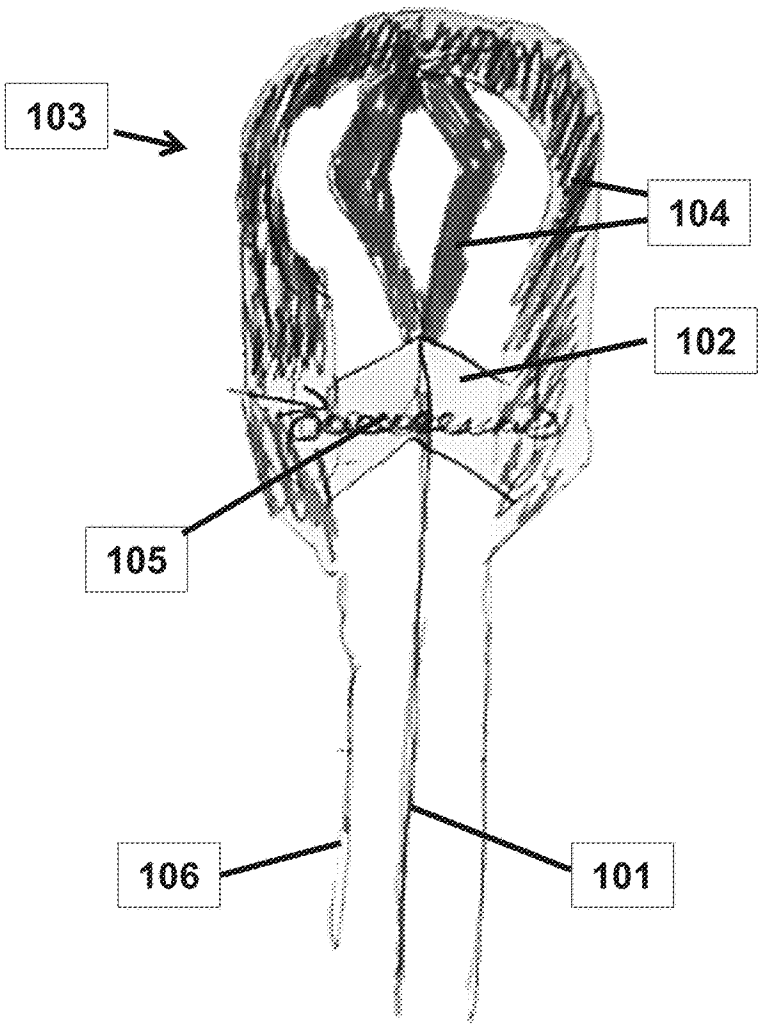
FIG. 3 depicts a portion of an exemplary embodiment of a pet waste scooping device that includes a grabber 103 that includes four appendages 104, a spring 105 connected to the appendages 104 (also referred to as a grabber spring), a latch 102, a pole 106, and a draw system includes a rope 101 that is an elastic rope.

In some embodiments, the rope 101 is connected to the latch 102, as depicted in FIG. 1 and FIG. 2. In some embodiments, the internal pole 114 is connected to the latch 102, as depicted in FIG. 5. The latch 102 is configured to cause the appendages 104 of the grabber 103 to reversibly expand outward to an open position when the rope is pulled or the internal pole is pulled. This outward expansion of the appendages, which is depicted in FIG. 2, is intended to allow the grabber to open up to fully surround the waste and then subsequently close around it to secure it. Accordingly, in some embodiments, the rope 101 is connected to a latch 102 that is configured to cause the at least three appendages to reversibly expand outward to an open position when the rope is pulled (FIG. 2), or the internal pole 114 is pulled, and to retract inward to a closed position when the rope is released or the internal pole is retracted due to tension caused by the spring (FIG. 3). For instance, in some embodiments, as the rope is being pulled toward the direction of the handle end 110 of the pole 106, this causes the latch 102 to move toward the handle end 110 of the pole 106, which, in some embodiments, results in pressure between the latch 102 and the appendages 104 of the grabber 103, causing the appendages 104 to expand outward to an open position. In some embodiments, as the rope is being pulled toward the direction of the handle end 110 of the pole 106, this causes the latch 102 to move toward the handle end 110 of the pole 106 such that the contact between the latch 102 and the appendages 104 causes the appendages 104 to expand outward to an open position. In some embodiments, as the internal pole 114 is being pulled toward the direction of the handle end 110 of the pole 106, this causes the latch 102 to move toward the handle end 110 of the pole 106 such that the contact between the latch 102 and the appendages 104 causes the appendages 104 to expand outward to an open position.

In some embodiments, the latch 102 comprises an arm. In some embodiments, the arm is on a hinge. In some embodiments, the arm comprises one, two, three, four, five, six, seven, or eight or more arms. In some embodiments, the latch 102 comprises an arm that is on a hinge, such as one, two, three, four, five, six, seven, or eight or more arms. In some embodiments, the latch comprises two, three, four, five, fix, seven, or eight or more arms that are each on a hinge. In some embodiments, each arm makes contact with one of the appendages, although, in some embodiments, two or more arms of the latch may make contact with each of the appendages. In some embodiments, the arm that is on a hinge is connected to the spring 105 such that, due to the resistance from the spring, the arm is kept in an inward (or retracted) position, but, upon pulling of the rope or the internal pole, the arm of the latch 102 makes contact with the pole 106, or another object connected to the pole 106, such that the arm expands outward, thereby causing the appendages of the grabber to expand outward to an open position. FIG. 5 depicts the grabber of an exemplary embodiment in a closed position due to the three arms of an exemplary latch being in an inward position due to the resistance from the spring.

In some embodiments, the pet waste scooping device comprises more than one spring 105, such as two springs, three springs, four springs, five springs, or six or more springs. In some embodiments, the more than one spring 105 are referred to, e.g., in numeric order as, e.g., a first spring 105, a second spring 105, etc., or based on what the spring is connected to, e.g., a grabber spring or a latch spring. In some embodiments, a spring 105 that is connected to a latch 102 is also referred to as a latch spring. In some embodiments, a spring 105 that is connected to a grabber 103, e.g., the at least three appendages of the grabber, is also referred to as a grabber spring. In some embodiments, a first spring 105 is connected to the grabber, and a second spring 105 is connected to the latch. In some embodiments, a first spring 105 is connected to the three or more appendages, and a second spring 105 is connected to the latch. In some embodiments, a first spring 105 is connected to the three or more appendages, and a second spring 105 is connected to an arm of the latch. A spring 105 as used herein includes, independently, a first spring 105, a second spring 105, etc., and a grabber spring, and a latch spring, and can independently refer, for instance, to a spring 105 that is connected to the grabber, the at least three appendages of the grabber, the latch, or the arm of the latch. In some embodiments, a grabber spring is a spring 105 that is connected to the grabber, and a latch spring is a spring 105 that is connected to the latch or the at least three arms of the latch. In some embodiments, a grabber spring is a spring 105 that is connected to the three or more appendages, and a latch spring is a spring 105 that is connected to the latch. In some embodiments, a grabber spring is a spring 105 that is connected to the three or more appendages, and a latch spring is a spring 105 that is connected to the arm of the latch.

The illuminating element 107 can, in some embodiments, be any element capable of providing illumination. In some embodiments, the pet waste scooping device comprises more than one illuminating element, such as at least two, at least three, at least four, or at least five or more illuminating elements. In some embodiments, the illuminating element 107 is a LED. In some embodiments, the illuminating element 107 comprises a LED. In some embodiments, the illuminating element is powered by a battery. In some embodiments, the battery is a lithium battery. In some embodiments, the battery is an alkaline battery. In some embodiments, the illuminating element is solar powered. In some embodiments, the illuminating element is connected to the pole 106. The illuminating element 107 can be connected to, or otherwise situated on, any portion of the pole 106. In some embodiments, the illuminating element 107 is connected to any part of the pole such that the illuminating element is capable of illuminating the user's surroundings, such as the ground as the user is walking a pet or scooping up waste. In some embodiments, the illuminating element is connected to the pole on the handle end of the pole. In some embodiments, the illuminating element is connected to the pole on the scooping end of the pole. In some embodiments, the illuminating element is connected to a waste bag dispenser.

In some embodiments, the pet waste scooping device further comprises a waste bag dispenser. The waste bag dispenser is intended to contain or house waste bags, such as any pet waste bag described herein, e.g., in section II. The waste bag dispenser can be configured to contain any suitable number of waste bags. In some embodiments, the waste bag dispenser contains at least 1, at least 2, at least 3, at least 4, at least 5, at least 10, at least 15, at least 20, at least 25, or at least 30 waste bags. In some embodiments, the waste bag dispenser comprises a storage compartment. In some embodiments, the waste bag dispenser comprises a storage compartment that can be opened to store and/or retrieve a waste bag. In some embodiments, the storage compartment is opened by opening or sliding a door or hatch. In some embodiments, the storage compartment comprises an aperture through which a waste bag is removed from the waste bag dispenser when needed. In some embodiments, the waste bag dispenser is attached to the pole 106.

In some embodiments, the pet waste scooping device further comprises waste bags. In some embodiments, the waste bag or the waste bags comprises any commercially available waste bag suitable for collecting pet waste, including those marketed and/or intended for uses other than collecting pet waste. In some embodiments, the waste bag or the waste bags comprises a pet waste bag as described in Section II. The waste bags can be any bag suitable for collecting pet waste, including any pet waste bag described herein in Section II.

In some embodiments, the pet waste scooping device is a pet waste scooping device as depicted in FIG. 1. In some embodiments, the pet waste scooping device includes features as depicted in FIG. 1. In some embodiments, the pet waste scooping device includes features as depicted in FIG. 2. In some embodiments, the pet waste scooping device includes features as depicted in FIG. 3. In some embodiments, the pet waste scooping device includes features as depicted in FIG. 4. In some embodiments, the pet waste scooping device includes features as depicted in FIG. 5. In some embodiments, the pet waste scooping device includes features as depicted in one or more of FIGS. 1-5.

The waste 113 that can be scooped using the pet waste scooping devices provided herein can be waste from any animal. In some embodiments, the animal is a pet. The pet can be any pet that leaves waste in need of scooping. In some embodiments, the pet is a dog or a cat. In some embodiments, the pet is a dog. The dog can be any breed of dog. In some embodiments, the animal is not a pet. Accordingly, although reference may be made to a pet's waste, this is not intended to limit the use of the pet waste scooping devices provided herein, which are also contemplated for use in scooping waste from pets and non-pets alike, such as in a park or a yard that is frequented by not only pets but also by wild life, such as deer, raccoons, coyotes, wolves, and the like—all of which may leave waste behind that can be scooped using the pet waste scooping devices provided herein.

In some embodiments, the waste 113 is scooped using the pet waste scooping devices provided herein and is placed into a pet waste bag that is removed from the waste bag dispenser. In some embodiments, the pet waste bag is placed over the appendages of the grabber such that, when grabbing or scooping the waste, the waste is engulfed within the pet waste bag, with the open end of the pet waste bag opening up to receive the waste. By placing the waste bag over the appendages of the grabber, the grabber can grab or scoop the waste into the pet waste bag without the waste coming into contact with the appendages of the grabber, thereby keeping the appendages of the grabber sanitary and clean. The pet waste bag can be any waste bag of suitable size and material for collecting waste. In some embodiments, the pet waste bag is any pet waste as described in section II.

II. Pet Waste Bags

The present disclosure also provides pet waste bags.

Specifically provided herein is a pet waste bag 115 comprising a body portion comprising an open end 116 and a closed end 117, and a peelable adhesive strip 118, as depicted in FIG. 6A. The open end is the end of the bag that includes the opening for receiving the pet waste. The closed end is the end of the bag, sometimes referred to as the base, that is closed or sealed and is used for securing the pet waste inside of the pet waste bag. In some embodiments, the pet waste bag further comprises a gripping texture 119. In some embodiments, the gripping texture is located on the outside and/or inside of a portion of the open end of the body portion. The gripping texture provides for benefits that include allowing the user to identify which end of the pet waste bag includes the opening, e.g., the open end, as well as allowing the user to more easily peel open the bag due to increased friction between the user's hand, i.e., finger(s), and the pet waste bag. In some embodiments, the peelable adhesive strip comprises the gripping texture.

In some embodiments, the peelable adhesive strip is attached to the open end of the body portion of the pet waste bag. In some embodiments, the peelable adhesive strip is part of the open end of the body portion of the pet waste bag. In some embodiments, the peelable adhesive strip is located on the outside of a portion of the open end of the body portion. In some embodiments, the portion of the open end comprises the rim of the open end.

In some embodiments, the peelable adhesive strip peels off of the pet waste bag and remains attached to the pet waste bag at one end. In some embodiments, the peelable adhesive strip remains attached to the pet waste bag due to an anchor 120. As such, in some embodiments, the pet waste bag comprises a body portion comprising an open end, a closed end, a peelable advise strip, and an anchor 120. In some embodiments, the body portion is connected to the anchor 120, and the anchor 120 is connected to the peelable adhesive strip, such that, when the peelable adhesive strip is fully peeled, it remains attached to the body portion of the pet waste bag at the anchor 120. For instance, the peelable adhesive strip may be attached by adhesive to the body portion and may be peeled off beginning at one end of the peelable adhesive strip, but does not fully peel off at the opposite end since it is anchored to the body portion via an anchor that does not peel off. This allows the peelable adhesive strip to remain attached to the pet waste bag so that the peelable adhesive strip, after being peeled, can be used to seal the pet waste bag closed by wrapping the peelable adhesive strip around the opening of the open end of the bag, which seals the bag closed due to the adhesive on the peelable adhesive strip.

In some embodiments, the peelable adhesive strip comprises an adhesive side and a non-adhesive side. The adhesive side comprises an adhesive portion. In some embodiments, the entire adhesive side comprises the adhesive portion. In some embodiments, a portion of the adhesive side comprises the adhesive portion. Prior to peeling the peelable adhesive strip from the pet waste bag, the adhesive side made contact with the body portion of the pet waste bag or is otherwise facing the direction of the body portion of the pet waste bag, while the non-adhesive side was outward facing. After peeling the peelable adhesive strip away from the pet waste bag, the adhesive side of the peelable adhesive strip, which is what was peeled away from the pet waste bag, is used to wrap around and seal the pet waste bag closed after the waste is collected inside of the pet waste bag, such as depicted in FIG. 6C.

The length of the peelable adhesive strip is not particularly limited and can be any suitable length. In some embodiments, the peelable adhesive strip is at least 0.5 inch, at least 0.75 inch, at least 1 inch, at least 1.5 inch, at least 2 inches, at least 2.5 inches, at least 3 inches, at least 3.5 inches, at least 4 inches, at least 4.5 inches, at least 5 inches, at least 5.5 inches, at least 6 inches, at least 6.5 inches, at least 7 inches, at least 7.5 inches, or is at least 8 inches in length. In some embodiments, the peelable adhesive strip is or is about 0.5 inch, is or is about 0.75 inch, is or is about 1 inch, is or is about 1.5 inch, is or is about 2 inches, is or is about 2.5 inches, is or is about 3 inches, is or is about 3.5 inches, is or is about 4 inches, is or is about 4.5 inches, is or is about 5 inches, is or is about 5.5 inches, is or is about 6 inches, is or is about 6.5 inches, is or is about 7 inches, is or is about 7.5 inches, or is or is about 8 inches in length.

In some embodiments, the adhesive portion of the adhesive side of the peelable adhesive strip is at least 0.25 inch, at least 0.5 inch, at least 0.75 inch, at least 1 inch, at least 1.5 inch, at least 2 inches, at least 2.5 inches, at least 3 inches, at least 3.5 inches, at least 4 inches, at least 4.5 inches, at least 5 inches, at least 5.5 inches, at least 6 inches, at least 6.5 inches, at least 7 inches, at least 7.5 inches, or is at least 8 inches in length. In some embodiments, the adhesive portion of the adhesive side of the peelable adhesive strip is or is about 0.25 inch, is or is about 0.5 inch, is or is about 0.75 inch, is or is about 1 inch, is or is about 1.5 inch, is or is about 2 inches, is or is about 2.5 inches, is or is about 3 inches, is or is about 3.5 inches, is or is about 4 inches, is or is about 4.5 inches, is or is about 5 inches, is or is about 5.5 inches, is or is about 6 inches, is or is about 6.5 inches, is or is about 7 inches, is or is about 7.5 inches, or is or is about 8 inches in length.

In some embodiments, the adhesive portion of the adhesive side of the peelable adhesive strip comprises at least 5%, at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, at least 95%, at least 96%, at least 97%, at least 98%, at least 99%, or 100% of the surface area of the adhesive side of the peelable adhesive strip.

In some embodiments, the peelable adhesive strip, when peeled, comprises a portion that is peeled off of the body portion and a portion that is not peeled off of the body portion. In some embodiments, the portion of the peelable adhesive strip that is peeled off of the body portion comprises adhesive, and the portion of the peelable adhesive strip that is not peeled off of the body portion does not comprise adhesive.

In some embodiments, the peelable adhesive strip, when peeled, can be wrapped around the open end of the pet waste bag that contains waste, thereby sealing the waste inside of the pet waste bag. In some embodiments, the portion of the peelable adhesive strip that is peeled off of the pet waste bag (or the body portion thereof) comprises adhesive and is wrapped around the open end of the pet waste bag that contains waste, thereby sealing the waste inside of the pet waste bag. In such embodiments, the adhesive on the peelable adhesive strip sticks to the pet waste bag and/or the peelable adhesive strip itself as it is being wrapped around the pet waste bag, e.g., the open end of the pet waste bag. This can be faster and more efficient than attempting to tie the open end of the pet waste bag closed, and can also allow the user to avoid excessive handling of the pet waste bag that includes the smelly waste. This can also allow for a tighter and more secure sealing of the pet waste bag, thereby reducing the smelly scent that is emitted from the pet waste bag.

In some embodiments comprising a gripping texture, the gripping texture can comprise any texture that provides an increase in friction between the user's finger and the pet waste bag, as compared to the non-textured parts of the pet waste bag.

In some embodiments, the gripping texture comprises a raised texture. In some embodiments, the raised texture comprises one or more of raised dots, raised lines, ridges, raised shapes, or any other raised pattern or style, or any combination thereof. In some embodiments, the raised texture comprises raised dots, such as depicted in FIG. 6A. The raised dots can, in some embodiments, resemble Braille. The raised shapes can be in any shape, such as a circle, square, oval, ring, ellipse, semi-circle, diamond, star, arrow, cross, heart, pentagon, rhombus, triangle, octagon, plus, minus, ring, etc.

In some embodiments, the gripping texture is attached to the open end of the body portion of the pet waste bag. In some embodiments, the gripping texture is located on or adjacent to the open end. In some embodiments, the gripping texture is part of the open end of the body portion of the pet waste bag. For instance, in some embodiments, the open end of the pet waste bag is molded, pressed, or otherwise produced such that it comprises the gripping texture. In some embodiments, the pet waste bag is plastic and the gripping texture is molded into the plastic.

In some embodiments, the gripping texture comprises a friction material that exhibits increased friction between the user's hand and the friction material as compared to the friction between the user's hand and the material of the body portion of the pet waste bag to which the friction material is applied, such as plastic or paper. The friction material can be any suitable material that can be applied to the body portion of the pet waste bag and that exhibits increased friction between the user's hand and the friction material as compared to the friction between the user's hand and the material of the body portion of the pet waste bag to which the friction material is applied, such as plastic or paper.

In some embodiments, the gripping texture is located on the outside of a portion of the open end of the body portion.

In some embodiments, the gripping texture is located on the inside of a portion of the open end of the body portion. In some embodiments, the gripping texture is located on the outside and inside of a portion of the open end of the body portion. In some embodiments, the portion of the open end comprises the rim of the open end. In some embodiments, the gripping texture is located on less than 5%, less than 10%, less than 15%, less than 20%, less than 25%, less than 30%, less than 35%, less than 40%, less than 45%, less than 50%, less than 55%, less than 60%, less than 65%, less than 70%, less than 75%, less than 80%, less than 85%, less than 90%, or less than 95% of the perimeter of the rim of the open end. In some embodiments, the gripping texture is located on about 1%, about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or about 100% of the perimeter of the rim of the open end. In some embodiments, the gripping texture is located on about 50% of the perimeter of the rim of the open end. In some embodiments, the gripping texture is located on 100% of the perimeter of the rim of the open end. In some embodiments, the gripping texture is located on about 1% to about 10%, about 1% to about 20%, about 5% to about 20%, about 5% to about 30%, about 5% to about 40%, about 5% to about 50%, about 10% to about 20%, about 10% to about 40%, about 10% to about 50%, about 10% to about 60%, about 20% to about 40%, about 20% to about 60%, about 20% to about 80%, about 40% to about 95%, about 40% to about 85%, about 40% to about 75%, about 25% to about 75%, about 30% to about 70%, about 35% to about 65%, about 40% to about 60%, or about 45% to about 55% of the perimeter of the rim of the open end.

In some embodiments, the perimeter of the rim of the open end is not particularly limited and can be any suitable length. In some embodiments, the perimeter of the rim of the open end is or is approximately the same as the perimeter of the grabber when the grabber is in an open position. In some embodiments, the perimeter of the rim of the open end is about 0.25 to 1 inch larger than the perimeter of the grabber when the grabber is in an open position. In some embodiments, the perimeter of the rim of the open end is about 0.25 inch, 0.5 inch, 0.75 inch, or 1 inch larger than the perimeter of the grabber when the grabber is in an open position. In some embodiments, the perimeter of the rim of the open end is or is about 6 inches, is or is about 7 inches, is or is about 8 inches, is or is about 9 inches, is or is about 10 inches, is or is about 11 inches, is or is about 12 inches, is or is about 13 inches, is or is about 14 inches, is or is about 15 inches, is or is about 16 inches, is or is about 17 inches, or is or is about 18 or more inches. In some embodiments, the perimeter of the rim of the open end is or is about 6 to 18 inches, is or is about 7 to 17 inches, is or is about 8 to 16 inches, is or is about 9 to 15 inches, is or is about 10 to 14 inches, or is or is about 11 to 13 inches.

In some embodiments, the gripping texture extends for about 0.25 inch, 0.5 inch, about 0.75 inch, about 1 inch, about 1.5 inch, about 2 inches, about 2.5 inches, about 3 inches, about 3.5 inches, about 4 inches, about 4.5 inches, about 5 inches, about 5.5 inches, about 6 inches, about 6.5 inches, about 7 inches, about 7.5 inches, about 8 inches, about 9 inches, about 10 inches, about 11 inches, about 12 inches, about 13 inches, about 14 inches, about 15 inches, about 16 inches, about 17 inches, or about 18 or more inches. In some embodiments, the gripping texture extends for up to about 0.5 inch, up to about 1 inch, up to about 2 inches, up to about 3 inches, up to about 4 inches, up to about 5 inches, up to about 6 inches, up to about 7 inches, up to about 8 inches, up to about 9 inches, up to about 10 inches, up to about 11 inches, up to about 12 inches, up to about 13 inches, up to about 14 inches, up to about 15 inches, up to about 16 inches, up to about 17 inches, or up to about 18 inches.

The open end of the body portion is not particularly limited and can be any shape or configuration. In some embodiments, the open end is a circle or oval shape. In some embodiments, the open end is flat and comprises a slit, such as the open end of a sandwich bag. In some embodiments, the open end is a triangle shape. In some embodiments, the open end is a square or rectangle shape. In some embodiments, the open end of the body portion configures to the shape of the grabber, due to its appendages, when placed on the grabber for retrieving pet waste.

The closed end of the body portion is not particularly limited and can be any shape or configuration. In some embodiments, the closed end is a circle or oval shape. In some embodiments, the closed end is flat, such as the closed end of a sandwich bag. In some embodiments, the closed end is round, such as depicted in FIG. 6B. In some embodiments, the closed end is round and half-spherical. In some embodiments, the closed end is a triangle shape. In some embodiments, the closed end is a square or rectangle shape.

The body portion of the pet waste bag can comprise any suitable material for containing pet waste. In some embodiments, the body portion of the pet waste bag comprises plastic. In some embodiments, the plastic is selected from the group consisting of HDPE, LDPE, and LLDPE. In some embodiments, the body portion of the pet waste bag comprises HDPE.

In some embodiments, the body portion of the pet waste bag comprises a biodegradable material. In some embodiments the biodegradable material is a biodegradable plastic material. In some embodiments, the biodegradable plastic material comprises a cellulose-based material.

In some embodiments, the open end and/or the closed end of the pet waste bag further comprises a perforated edge 121, such as depicted in FIG. 6D. In some embodiments, the preformatted edge 121 separates the pet waste bag from another pet waste bag and allows for easy separation of a pet waste bag from another pet waste bag, such as when the pet waste bags are contained within a roll and linked together, but are in need of being separated prior to use. In some embodiments, the closed end of a first pet waste bag comprises a perforated edge 121 that links the first pet waste bag to the open end of a second pet waste bag, and the closed end of the second pet waste bag comprises a preformatted edge 121 that links the second pet waste bag to the open end of a third pet waste bag, and so on and so forth.

Also provided herein is a package of pet waste bags, comprising two or more of any of the pet waste bags described herein, e.g., in section II. In some embodiments, the two or more pet waste bags is, is about, is at least, or is at least about 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 100, 125, 150, 175, 200, 225, or 250 of any of the pet waste bags described herein. In some embodiments, the two or more pet waste bags are linked together. In some embodiments, the two or more pet waste bags are linked together, and each of the two or more pet waste bags comprise a perforated edge on the open end and/or the closed end of the body portion.

III. Pet Waste Collection Kit

Also provided herein is a pet waste collection kit, comprising any pet waste scooping device described herein, e.g., any pet waste bag as described in section I, and any pet waste bag described herein, e.g., any pet waste bag described in section II.

In some embodiments, the pet waste collection kit further comprises instructions for use of the pet waste collection kit, including instructions for use of the pet waste scooping device and/or instructions for use of the pet waste bag.

IV. Methods of Manufacturing

Provided herein are methods of manufacturing a pet waste scooping device, including any pet waste scooping device described herein.

In some embodiments, the method comprises obtaining a pole, connecting the pole to a grabber comprising at least three appendages, connecting a rope to a latch that is configured to cause the at least three appendages to reversible expand outward to an open position when the rope is pulled, and connecting a spring to the at least three appendages. In some embodiments, the method further comprises connecting an illuminating element to the pole. In some embodiments, the method further comprises connecting a button to the pole for extending and/or enlarging the grabber, e.g., while in a closed position.

In some embodiments, the method comprises obtaining a collapsible pole, connecting the collapsible pole to a grabber comprising at least three appendages, connecting a rope to a latch that is configured to cause the at least three appendages to reversible expand outward to an open position when the rope is pulled, and connecting a spring to the at least three appendages. In some embodiments, the method further comprises connecting an illuminating element to the pole. In some embodiments, the method further comprises connecting a button to the pole for extending and/or enlarging the grabber, e.g., while in a closed position.

In some embodiments, the method comprises obtaining a pole, connecting the pole to a grabber comprising at least three appendages, connecting a rope to a latch that is configured to cause the at least three appendages to reversible expand outward to an open position when the rope is pulled, connecting a spring to the at least three appendages, and connecting a waste bag dispenser to the pole. In some embodiments, the method further comprises connecting an illuminating element to the pole. In some embodiments, the method further comprises connecting a button to the pole for extending and/or enlarging the grabber, e.g., while in a closed position.

In some embodiments, the method comprises obtaining a collapsible pole, connecting the collapsible pole to a grabber comprising at least three appendages, connecting a rope to a latch that is configured to cause the at least three appendages to reversible expand outward to an open position when the rope is pulled, connecting a spring to the at least three appendages, and connecting a waste bag dispenser to the collapsible pole. In some embodiments, the method further comprises connecting an illuminating element to the pole. In some embodiments, the method further comprises connecting a button to the pole for extending and/or enlarging the grabber, e.g., while in a closed position.

In some embodiments, the method comprises obtaining a pole, connecting the pole to a grabber comprising at least three appendages, connecting an internal pole to a latch that is configured to cause the at least three appendages to reversible expand outward to an open position when the rope is pulled, and connecting a spring to the at least three appendages. In some embodiments, the method further comprises connecting an illuminating element to the pole. In some embodiments, the method further comprises connecting a button for extending and/or enlarging the grabber to the pole.

In some embodiments, the method comprises obtaining a collapsible pole, connecting the collapsible pole to a grabber comprising at least three appendages, connecting an internal pole to a latch that is configured to cause the at least three appendages to reversible expand outward to an open position when the internal pole is pulled, and connecting a spring to the at least three appendages. In some embodiments, the method further comprises connecting an illuminating element to the pole. In some embodiments, the method further comprises connecting a button to the pole for extending and/or enlarging the grabber, e.g., while in a closed position.

In some embodiments, the method comprises obtaining a pole, connecting the pole to a grabber comprising at least three appendages, connecting an internal pole to a latch that is configured to cause the at least three appendages to reversible expand outward to an open position when the internal pole is pulled, connecting a spring to the at least three appendages, and connecting a waste bag dispenser to the pole. In some embodiments, the method further comprises connecting an illuminating element to the pole. In some embodiments, the method further comprises connecting a button to the pole for extending and/or enlarging the grabber, e.g., while in a closed position.

In some embodiments, the method comprises obtaining a collapsible pole, connecting the collapsible pole to a grabber comprising at least three appendages, connecting an internal pole to a latch that is configured to cause the at least three appendages to reversible expand outward to an open position when the internal pole is pulled, connecting a spring to the at least three appendages, and connecting a waste bag dispenser to the collapsible pole. In some embodiments, the method further comprises connecting an illuminating element to the pole. In some embodiments, the method further comprises connecting a button to the pole for extending and/or enlarging the grabber, e.g., while in a closed position.

Also provided herein are methods of manufacturing a pet waste bag, including any pet waste bag described herein, e.g., in section II. In some embodiments, the method comprises obtaining a body portion comprising an open end and a closed end, connecting a peelable adhesive strip to the body portion, and applying a gripping texture to the body portion. In some embodiments, the gripping texture is applied to the outside and/or inside of a portion of the open end of the body portion. In some embodiments, the gripping texture is applied to a portion of the open end that comprises the rim of the open end.

Also provided herein are methods of manufacturing a pet waste collection kit, including any pet waste collection kit described herein. In some embodiments, the method comprises obtaining a pet waste scooping device, and obtaining a pet waste bag. In some embodiments, the pet waste scooping device is obtained using any of the methods of manufacturing described herein, such as in section IV, and the pet waste bag is obtained by using any of the methods of manufacturing described herein, such as in section IV.

V. Methods of Using

Provided herein are methods of using any of the pet waste scooping devices provided herein. In some embodiments, provided herein is a method of scooping waste from a pet, the method comprising: obtaining any of the pet waste scooping devices described herein comprising a collapsible pole; extending the collapsible pole to a longer length;

pulling the rope; situating the appendages around waste; and releasing the rope. In some embodiments comprising a waste bag dispenser, the method further comprises removing a waste bag from the waste bag dispenser.

Also provided herein are methods of using any of the pet waste bags provided herein. In some embodiments, provided herein is a method of using a pet waste bag, the method comprising: obtaining any of the pet waste bags described herein, e.g., in section II, comprising an open end and a closed end; opening the open end of the pet waste bag; placing the open end of the pet waste bag over the waste; collecting the waste inside of the pet waste bag; peeling the peelable adhesive strip; closing the open end of the pet waste bag; and securing the pet waste bag closed using the peelable adhesive strip. In some embodiments, placing the open end of the pet waste bag over the waste is performed using a pet waste scooping device, such as any pet waste scooping device described herein, e.g., in section I, or any commercially available pet waste scooping device (commonly known as "pooper scoopers"), by, e.g., placing the pet waste bag over the portion of the pet waste scooping device that is responsible for retrieving the waste, such as the grabber of the pet waste scooping device described herein.

Also provided herein are methods of using any of the pet waste collection kits provided herein. In some embodiments, provided herein is a method using a pet waste collection kit, the method comprising: obtaining any of the pet waste scooping devices described herein comprising a collapsible pole; extending the collapsible pole to a longer length; pulling the rope; obtaining a pet waste bag described herein; opening the pet waste bag; placing the pet waste bag over the appendages; situating the appendages around waste; and releasing the rope.

In some of any of such embodiments, the method further comprises peeling the peelable adhesive strip, and wrapping the portion of the peelable adhesive strip that is peeled off of the body portion and comprises adhesive around the open end of the pet waste bag, thereby sealing the waste inside of the pet waste bag.

Unless defined otherwise, all terms of art, notations and other technical and scientific terms or terminology used herein are intended to have the same meaning as is commonly understood by one of ordinary skill in the art to which the claimed subject matter pertains. In some cases, terms with commonly understood meanings are defined herein for clarity and/or for ready reference, and the inclusion of such definitions herein should not necessarily be construed to represent a substantial difference over what is generally understood in the art.

As used herein, the singular forms "a," "an," and "the" include plural referents unless the context clearly dictates otherwise. For example, "a" or "an" means "at least one" or "one or more." It is understood that aspects and variations described herein include "consisting" and/or "consisting essentially of" aspects and variations.

Throughout this disclosure, various aspects of the claimed subject matter are presented in a range format. It should be understood that the description in range format is merely for convenience and brevity and should not be construed as an inflexible limitation on the scope of the claimed subject matter. Accordingly, the description of a range should be considered to have specifically disclosed all the possible sub-ranges as well as individual numerical values within that range. For example, where a range of values is provided, it is understood that each intervening value, between the upper and lower limit of that range and any other stated or intervening value in that stated range is encompassed within the claimed subject matter. The upper and lower limits of these smaller ranges may independently be included in the smaller ranges, and are also encompassed within the claimed subject matter, subject to any specifically excluded limit in the stated range. Where the stated range includes one or both of the limits, ranges excluding either or both of those included limits are also included in the claimed subject matter. This applies regardless of the breadth of the range.

Reference to "the perimeter of the rim of the open end" refers to the length around the opening of the pet waste bag, which can be calculated, for instance, in terms of centimeters or inches. The perimeter can be calculated by any acceptable means, including measuring the length around the opening of the pet waste bag or by use of a formula for calculating the perimeter of a shape.

The term "biodegradable" as used herein, e.g., a biodegradable material, refers to a material that is capable of being decomposed by bacteria or other living organisms.

VI. Exemplary Embodiments

Provided herein are the following exemplary embodiments:

1. A pet waste scooping device, comprising:
   a pole connected to a grabber comprising at least three appendages; and
   a rope connected to a latch that is configured to cause the at least three appendages to reversibly expand outward to an open position when the rope is pulled.
2. The pet waste scooping device of embodiment 1, further comprising a stopper connected to the rope.
3. The pet waste scooping device of embodiment 1, wherein the pole has a handle end and a scooping end, and wherein the pet waste scooping device further comprises a stopper connected to the rope at the handle end of the pole.
4. The pet waste scooping device of any one of embodiments 1-3, further comprising a wrist loop connected to the rope.
5. The pet waste scooping device of embodiment 2, further comprising a wrist loop connected to the stopper.
6. The pet waste scooping device of any one of embodiments 1-5, wherein the rope passes through the interior of the pole.
7. The pet waste scooping device of any one of embodiments 1-6, wherein the rope comprises an elastic rope.
8. The pet waste scooping device of any one of embodiments 1-7, wherein the rope is a coiled cord.
9. The pet waste scooping device of embodiment 8, wherein the coiled cord comprises a rope covered in rubber.
10. The pet waste scooping device of any one of embodiments 1-9, wherein the pole is a collapsible pole.
11. The pet waste scooping device of any one of embodiments 1-10, wherein the pole is a telescoping collapsible pole.
12. The pet waste scooping device of any one of embodiments 1-11, wherein the grabber is extendable and/or enlargeable.
13. The pet waste scooping device of any one of embodiments 1-12, wherein the grabber is extendable and/or enlargeable while in a closed position.
14. The pet waste scooping device of any one of embodiments 1-13, further comprising a button configured to carry out the extending and/or enlarging of the grabber while in a closed position.

15. The pet waste scooping device of embodiment 14, wherein the button is a slide-button that is connected to the at least three appendages.
16. The pet waste scooping device of embodiment 15, wherein the pole comprises a handle end and a scooping end, and wherein, when the slide-button is slid away from the handle end of the pole, the at least three appendages are extended.
17. The pet waste scooping device of any one of embodiments 1-16, further comprising a waste bag dispenser.
18. The pet waste scooping device of embodiment 17, wherein the waste bag dispenser is attached to the pole.
19. The pet waste scooping device of any one of embodiments 1-18, further comprising an illuminating element.
20. The pet waste scooping device of embodiment 19, wherein the illuminating element comprises a light emitting diode (LED).
21. The pet waste scooping device of embodiment 19 or 20, wherein the illuminating element is connected to the pole.
22. The pet waste scooping device of embodiment 19 or 20, wherein the illuminating element is connected to the grabber.
23. The pet waste scooping device of embodiment 19 or 20, wherein the illuminating element is connected to the waste bag dispenser.
24. A pet waste scooping device, comprising:
an external pole connected to a grabber comprising at least three appendages; and
an internal pole connected to a latch that is configured to cause the at least three appendages to reversibly expand outward to an open position when the internal pole is pulled.
25. The pet waste scooping device of embodiment 24, further comprising a stopper connected to the internal pole.
26. The pet waste scooping device of embodiment 24, wherein the external pole has a handle end and a scooping end, and wherein the pet waste scooping device further comprises a stopper connected to the internal pole at the handle end of the external pole.
27. The pet waste scooping device of any one of embodiments 24-26, further comprising a wrist loop connected to the internal pole.
28. The pet waste scooping device of embodiment 25, further comprising a wrist loop connected to the stopper.
29. The pet waste scooping device of any one of embodiments 24-28, wherein the internal pole is a collapsible pole.
30. The pet waste scooping device of embodiment 29, wherein the internal pole is a telescoping collapsible pole.
31. The pet waste scooping device of any one of embodiments 24-30, wherein the external pole is a collapsible pole.
32. The pet waste scooping device of any one of embodiments 24-31, wherein the external pole is a telescoping collapsible pole.
33. The pet waste scooping device of any one of embodiments 24-32, wherein the grabber is extendable and/or enlargeable.
34. The pet waste scooping device of any one of embodiments 24-33, wherein the grabber is extendable and/or enlargeable while in a closed position.
35. The pet waste scooping device of embodiment 33 or 34, further comprising a button configured to carry out the extending and/or enlarging of the grabber while in a closed position.
36. The pet waste scooping device of embodiment 35, wherein the button is a slide-button that is connected to the at least three appendages.
37. The pet waste scooping device of embodiment 36, wherein the pole comprises a handle end and a scooping end, and wherein, when the slide-button is slid away from the handle end of the external pole, the at least three appendages are extended.
38. The pet waste scooping device of any one of embodiments 24-37, further comprising a waste bag dispenser.
39. The pet waste scooping device of embodiment 38, wherein the waste bag dispenser is attached to the external pole.
40. The pet waste scooping device of any one of embodiments 24-39, further comprising an illuminating element.
41. The pet waste scooping device of embodiment 40, wherein the illuminating element comprises a LED.
42. The pet waste scooping device of embodiment 40 or 41, wherein the illuminating element is connected to the external pole.
43. The pet waste scooping device of embodiment 40 or 41, wherein the illuminating element is connected to the grabber.
44. The pet waste scooping device of embodiment 40 or 41, wherein the illuminating element is connected to the waste bag dispenser.
45. The pet waste scooping device of any one of embodiments 1-44, wherein the at least three appendages are connected to a grabber spring.
46. The pet waste scooping device of embodiment 45, wherein the grabber spring is a compression spring.
47. The pet waste scooping device of any one of embodiments 1-46, wherein the at least three appendages are curved.
48. The pet waste scooping device of any one of embodiments 1-47, wherein the grabber comprises three, four, five, six, seven, or eight appendages.
49. The pet waste scooping device of embodiment 48, wherein the grabber comprises four appendages.
50. The pet waste scooping device of any one of embodiments 1-49, wherein the latch is connected to a latch spring.
51. The pet waste scooping device of any one of embodiments 1-50, wherein the latch comprises an arm.
52. The pet waste scooping device of any one of embodiments 1-49, wherein the latch comprises an arm, and a latch spring is connected to the arm.
53. The pet waste scooping device of embodiment 51 or 52, wherein the arm is one, two, three, four, five, six, seven, or eight arms.
54. The pet waste scooping device of any one of embodiments 51-53, wherein the arm is on a hinge.
55. The pet waste scooping device of any one of embodiments 51-54, wherein, when the internal pole is pulled, each of the three or more appendages is contacted by the arm.
56. The pet waste scooping device of any one of embodiments 50-55, wherein the latch spring is a compression spring.
57. The pet waste scooping device of any one of embodiments 12-23 and 33-56, wherein, when extended and/or enlarged, the diameter of the grabber increases by at least 25%, at least 50%, at least 75%, at least 100%, at least 150%, at least 200%, at least 300%, at least 400% or at least 500%.

58. The pet waste scooping device of any one of embodiments 17-23 and 38-57, wherein the waste bag dispenser is configured to contain at least 1, at least 2, at least 3, at least 4, at least 5, at least 10, at least 15, at least 20, at least 25, or at least 30 waste bags.

59. The pet waste scooping device of any one of embodiments 17-23 and 38-58, wherein the waste bag dispenser comprises a storage compartment.

60. The pet waste scooping device of any one of embodiments 17-23 and 38-59, further comprising a pet waste bag.

61. A pet waste bag, comprising:

a body portion comprising an open end and a closed end; and a peelable adhesive strip connected to the body portion by an anchor.

62. The pet waste bag of embodiment 61, wherein the peelable adhesive strip is located on the open end of the body portion.

63. The pet waste bag of embodiment 61 or 62, wherein the open end comprises a rim and the peelable adhesive strip is located on or adjacent to the rim.

64. The pet waste bag of embodiment 61 or 62, wherein the open end comprises a rim and the peelable adhesive strip is located no more than 0.5 inch, 1 inch, 1.5 inch, 2 inches, 2.5 inches, or 3 inches from the rim.

65. The pet waste bag of any one of embodiments 61-64, wherein the anchor is located on the open end of the body portion.

66. The pet waste bag of any one of embodiments 61-65, wherein the open end comprises a rim and the anchor is located on or adjacent to the rim.

67. The pet waste bag of any one of embodiments 61-65, wherein the open end comprises a rim and the anchor is located no more than 0.5 inch, 1 inch, 1.5 inch, 2 inches, 2.5 inches, or 3 inches from the rim.

68. The pet waste bag of any one of embodiments 61-67, wherein, when the peelable adhesive strip is peeled, the peelable adhesive strip remains connected to the body portion by the anchor.

69. The pet waste bag of any one of embodiments 61-68, wherein the peelable adhesive strip comprises an adhesive side and a non-adhesive side.

70. The pet waste bag of any one of embodiments 61-69, wherein, when the peelable adhesive strip is peeled, the portion of the peelable adhesive strip that is peeled off of the body portion comprises adhesive.

71. The pet waste bag of any one of embodiments 61-69, wherein, when the peelable adhesive strip is peeled, the portion of the peelable adhesive strip that is not peeled off of the body portion does not comprise adhesive.

72. The pet waste bag of any one of embodiments 61-71, wherein the peelable adhesive strip is at least 0.5 inch, at least 0.75 inch, at least 1 inch, at least 1.5 inch, at least 2 inches, at least 2.5 inches, at least 3 inches, at least 3.5 inches, at least 4 inches, at least 4.5 inches, at least 5 inches, at least 5.5 inches, or at least 6 inches in length.

73. The pet waste bag of any one of embodiments 61-72, further comprising a gripping texture.

74. The pet waste bag of embodiment 73, wherein the gripping texture comprises a raised texture.

75. The pet waste bag of embodiment 74, wherein the raised texture comprises one or more of raised dots, raised lines, ridges, raised shapes, or any combination thereof.

76. The pet waste bag of any one of embodiments 73-75, wherein the gripping texture is located on or adjacent to the open end.

77. The pet waste bag of any one of embodiments 61-76, wherein the open end comprises a rim and the gripping texture is located on or adjacent to the rim.

78. The pet waste bag of any one of embodiments 61-77, wherein the gripping texture is located on about 1% to about 10%, about 1% to about 20%, about 5% to about 20%, about 5% to about 30%, about 5% to about 40%, about 5% to about 50%, about 10% to about 20%, about 10% to about 40%, about 10% to about 50%, about 10% to about 60%, about 20% to about 40%, about 20% to about 60%, about 20% to about 80%, about 40% to about 95%, about 40% to about 85%, about 40% to about 75%, about 25% to about 75%, about 30% to about 70%, about 35% to about 65%, about 40% to about 60%, or about 45% to about 55% of the perimeter of the rim.

79. The pet waste bag of any one of embodiments 61-78, wherein the gripping texture extends for up to about 0.5 inch, up to about 1 inch, up to about 2 inches, up to about 3 inches, up to about 4 inches, up to about 5 inches, or up to about 6 inches.

80. The pet waste bag of any one of embodiments 61-79, wherein the body portion comprises plastic.

81. The pet waste bag of embodiment 80, wherein the plastic is selected from the group consisting of high-density polyethylene (HDPE), low-density polyethylene (LDPE), and linear low-density polyethylene (LLDPE). In some embodiments, the body portion of the pet waste bag comprises HDPE.

82. The pet waste bag of any one of embodiments 61-79, wherein the body portion comprises a biodegradable material.

83. The pet waste bag of embodiment 82, wherein the biodegradable material is a biodegradable plastic material.

84. The pet waste bag of embodiment 82 or 83, wherein the biodegradable material comprises a cellulose-based material.

85. The pet waste bag of any one of embodiments 61-84, wherein the open end and/or the closed end further comprises a perforated edge.

86. A package of pet waste bags, comprising two or more of the pet waste bags of any one of embodiments 61-85.

87. The package of pet waste bags of embodiment 86, wherein the two or more of the pet waste bag is, is about, is at least, or is at least about 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 100, 125, 150, 175, 200, 225, or 250 of the pet waste bag of any one of embodiments 46-70.

88. The package of pet waste bags of embodiment 86 or 87, wherein the two or more pet waste bags are linked together.

89. The package of pet waste bags of embodiment 86 or 87, wherein the two or more pet waste bags are linked together by a perforated edge.

90. The package of pet waste bags of any one of embodiments 86-89, wherein the two or more pet waste bags are linked together, and each of the two or more pet waste bags comprise a perforated edge on the open end and/or the closed end of the body portion.

91. A pet waste collection kit, comprising:
a pet waste scooping device of any one of embodiments 1-60; and
a pet waste bag of any one of embodiments 61-85.

92. The pet waste collection kit of embodiment 91, further comprising instructions for use.

93. A pet waste collection kit, comprising:
a pet waste scooping device of any one of embodiments 1-60; and
a package of pet waste bags of any one of embodiments 86-90.

94. The pet waste collection kit of embodiment 93, further comprising instructions for use.

95. A method of manufacturing a pet waste scooping device, comprising:
obtaining a pole;
connecting the pole to a grabber comprising at least three appendages;
connecting a rope to a latch that is configured to cause the at least three appendages to reversible expand outward to an open position when the rope is pulled; and
connecting a spring to the at least three appendages.

96. The method of embodiment 95, further comprising connecting an illuminating element to the pole.

97. The method of embodiment 95 or 96, further comprising connecting a button to the pole for extending and/or enlarging the grabber while in a closed position.

98. The method of any one of embodiments 95-97, further comprising connecting a waste bag dispenser to the pole.

99. The method of any one of embodiments 95-98, wherein the pole is a collapsible pole.

100. A method of manufacturing a pet waste scooping device, comprising:
obtaining an external pole;
connecting the external pole to a grabber comprising at least three appendages;
connecting an internal pole to a latch that is configured to cause the at least three appendages to reversible expand outward to an open position when the internal pole is pulled; and
connecting a spring to the at least three appendages.

101. The method of embodiment 100, further comprising connecting an illuminating element to the external pole.

102. The method of embodiment 100 or 101, further comprising connecting a button to the external pole for extending and/or enlarging the grabber while in a closed position.

103. The method of any one of embodiments 100-102, further comprising connecting a waste bag dispenser to the external pole.

104. The method of any one of embodiments 100-103, wherein the external pole is a collapsible pole.

105. A method of manufacturing a pet waste bag, comprising:
obtaining a body portion comprising an open end and a closed end;
connecting a peelable adhesive strip to the body portion; and
applying a gripping texture to the body portion.

106. The method of embodiment 105, further comprising connecting an anchor that connects the peelable adhesive strip to the body portion.

107. A method of scooping waste from a pet, comprising:
obtaining a pet waste scooping device of any one of embodiments 1-23 and 45-60;
extending the pole to a longer length;
pulling the rope;
situating the three or more appendages around waste; and
releasing the rope.

108. A method of scooping waste from a pet, comprising:
obtaining a pet waste scooping device of any one of embodiments 24-60-45;
extending the external pole to a longer length;
pulling the internal pole;
situating the three or more appendages around waste; and
releasing the internal pole and/or returning the internal pole to its location prior to the pulling of the internal pole.

109. A method of scooping waste from a pet, comprising:
obtaining a pet waste scooping device of any one of embodiments 1-23 and 45-60;
extending the pole to a longer length;
pulling the rope;
obtaining a pet waste bag of any one embodiments 61-85;
placing the pet waste bag over the three or more appendages;
situating the three or more appendages around waste; and
releasing the rope.

110. A method of scooping waste from a pet, comprising:
obtaining a pet waste scooping device of any one of embodiments 24-60;
extending the external pole to a longer length;
pulling the internal pole;
obtaining a pet waste bag of any one embodiments 61-85;
placing the pet waste bag over the three or more appendages;
situating the three or more appendages around waste; and
releasing the internal pole and/or returning the internal pole to its location prior to the pulling of the internal pole.

111. The method of embodiment 109 or 110, further comprising peeling the peelable adhesive strip, and wrapping the portion of the peelable adhesive strip that is peeled off of the body portion and comprises adhesive around the open end of the pet waste bag, thereby sealing the waste inside of the pet waste bag.

What is claimed is:

1. A pet waste scooping device, comprising:
an external pole connected to a grabber comprising at least three appendages; and
an internal pole connected to a latch that is configured to cause the at least three appendages to reversibly expand outward to an open position when the internal pole is pulled,
wherein the latch comprises at least one arm that is retracted inward by a latch spring, and
wherein, when the internal pole is pulled, the at least one arm of the latch expands outward, thereby causing the at least three appendages of the grabber to expand outward.

2. The pet waste scooping device of claim 1, wherein the internal pole is a collapsible pole.

3. The pet waste scooping device of claim 1, wherein the at least three appendages are connected to a grabber spring.

4. The pet waste scooping device of claim 1, wherein the grabber is extendable and/or enlargeable.

5. The pet waste scooping device of claim 4, further comprising a button configured to carry out extending and/or enlarging of the grabber while in a closed position.

6. The pet waste scooping device of claim 5, wherein the button is a slide-button that is connected to the at least three appendages.

7. The pet waste scooping device of claim 6, wherein the external pole comprises a handle end and a scooping end, and wherein, when the slide-button is slid away from the handle end of the external pole, the at least three appendages are extended.

8. The pet waste scooping device of claim 1, further comprising a waste bag dispenser.

9. The pet waste scooping device of claim 1, further comprising an illuminating element.

10. A pet waste collection kit, comprising:

(a) a pet waste scooping device comprising:

(i) a pole connected to a grabber comprising at least three appendages; and (ii) a rope connected to a latch that is configured to cause the at least three appendages to reversibly expand outward to an open position when the rope is pulled; and (b) a pet waste bag comprising:

(i) a body portion comprising an open end and a closed end;

(ii) a gripping texture on or adjacent to the open end, wherein the gripping texture is a raised texture; and (iii) a peelable adhesive strip connected to the body portion by an anchor.

11. A pet waste collection kit, comprising:

(a) a pet waste scooping device comprising:

(i) a pole connected to a grabber comprising at least three appendages; and (ii) a rope connected to a latch that is configured to cause the at least three appendages to reversibly expand outward to an open position when the rope is pulled; and (b) a package of pet waste bags comprising two or more pet waste bags, wherein each of the two or more pet waste bags comprises:

(i) a body portion comprising an open end and a closed end;

(ii) a gripping texture on or adjacent to the open end, wherein the gripping texture is a raised texture; and (iii) a peelable adhesive strip connected to the body portion by an anchor.

* * * * *